US008628422B2

(12) United States Patent
Allen et al.

(10) Patent No.: US 8,628,422 B2
(45) Date of Patent: Jan. 14, 2014

(54) GAMING SYSTEM HAVING VIRTUAL ASSETS AND ACHIEVEMENTS

(75) Inventors: Jeffrey L. Allen, Naperville, IL (US); Peter R. Anderson, Glenview, IL (US); Stephen P. Angelo, Chicago, IL (US); Mark B. Gagner, West Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 386 days.

(21) Appl. No.: 13/124,247

(22) PCT Filed: Oct. 14, 2009

(86) PCT No.: PCT/US2009/060650

§ 371 (c)(1),
(2), (4) Date: Apr. 14, 2011

(87) PCT Pub. No.: WO2010/045333

PCT Pub. Date: Apr. 22, 2010

(65) Prior Publication Data

US 2011/0207525 A1 Aug. 25, 2011

Related U.S. Application Data

(60) Provisional application No. 61/196,020, filed on Oct. 14, 2008.

(51) Int. Cl.
*A63F 9/24* (2006.01)

(52) U.S. Cl.
USPC ..... 463/42; 463/16; 463/20; 463/25; 273/138.1; 273/139

(58) Field of Classification Search
USPC ..... 463/16, 20, 25, 42; 273/138.1, 139
See application file for complete search history.

(56) References Cited

U.S. PATENT DOCUMENTS

| | | | | |
|---|---|---|---|---|
| 6,068,553 | A * | 5/2000 | Parker | 463/27 |
| 2003/0003997 | A1 | 1/2003 | Vuong et al. | |
| 2003/0171145 | A1 * | 9/2003 | Rowe | 463/25 |
| 2004/0106454 | A1 * | 6/2004 | Walker et al. | 463/42 |
| 2005/0054446 | A1 | 3/2005 | Kammler et al. | |
| 2008/0220841 | A1 * | 9/2008 | Gagner et al. | 463/16 |
| 2009/0318215 | A1 * | 12/2009 | Acres | 463/20 |

FOREIGN PATENT DOCUMENTS

WO WO 01/84906 11/2001

OTHER PUBLICATIONS

International Search Report, PCT/US2009/060650, dated Dec. 7, 2009 1 page.

* cited by examiner

*Primary Examiner* — David L Lewis
*Assistant Examiner* — Chase Leichliter
(74) *Attorney, Agent, or Firm* — Nixon Peabody LLP

(57) ABSTRACT

A gaming system having virtual assets comprises a wager input device, at least one gaming terminal comprising a display for displaying a wagering game, and a virtual asset server in communication with the at least one gaming terminal, the virtual asset server storing and managing one or more types of virtual assets, each type of virtual asset having a different plurality of attributes associated therewith. The system comprises at least one controller operative to cause the first display to display the first wagering game, in response to a first triggering event, award one or more of the virtual assets to a player of the first wagering game, store information regarding the awarded virtual assets in a player account associated with the player and accessible to the virtual asset server, and provide a monetary award to the player for any winning outcomes achieved during play of the first wagering game.

20 Claims, 15 Drawing Sheets

GAMING SYSTEM HAVING VIRTUAL ASSETS AND ACHIEVEMENTS

PRIORITY CLAIM AND CROSS REFERENCE TO RELATED APPLICATIONS

This application is a U.S. national stage of International Application No. PCT/US2009/060650, filed Oct. 14, 2009, which is related to and claims priority to U.S. Provisional Application No. 61/196,020, filed Oct. 14, 2008, each of which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, and methods for playing wagering games, and more particularly, to gaming systems having virtual assets, achievements and trophies.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

To increase appeal, some gaming terminals may include virtual, non-cash or intangible assets, such as achievements, trophies, or prizes which the player can earn, accumulate, and display as indicia of prowess, skill, luck, or performance in various aspects of wagering games. One way to further excitement and entertainment value of such gaming terminals is to display and allow receipt, collection, accumulation and redemption of such virtual assets.

SUMMARY OF THE INVENTION

According to one aspect of the present invention, a gaming system having virtual assets comprises a wager input device, at least one gaming terminal comprising a display for displaying a wagering game, and a virtual asset server in communication with at least one gaming terminal, the virtual asset server storing and managing one or more types of virtual assets, each type of virtual asset having a different plurality of attributes associated therewith. The system comprises at least one controller operative to (i) cause the first display to display the first wagering game, (ii) in response to a first triggering event, award one or more of the virtual assets to a player of the first wagering game, (iii) store information regarding the awarded virtual assets in a player account associated with the player and accessible to the virtual asset server, and (iv) provide a monetary award to the player for any winning outcomes achieved during play of the first wagering game.

According to another aspect of the invention, a method of conducting a wagering game comprises accessing and recalling a player account in response to receiving a player identifier, receiving a wager, and displaying a wagering game on a display of a gaming terminal. The method further comprises storing and managing one or more types of virtual assets on a virtual asset server in communication with the gaming terminal, each type of virtual asset having a different plurality of attributes associated therewith. In response to a triggering event, one or more of the virtual assets is awarded to the player. The method further comprises storing information regarding the awarded virtual assets in the player account associated with the player and accessible to the virtual asset server, and providing a monetary award to the player for any winning outcomes achieved during play of the first wagering game.

According to yet another aspect of the invention, a gaming system having virtual assets, comprises a wager input device, a plurality of gaming terminals, each gaming terminal comprising a display for displaying a wagering game, and a virtual asset server in communication with the plurality of gaming terminals, the virtual asset server storing a plurality of player accounts and a set of virtual assets associated with each player account, the virtual asset server further storing a master rule set for management of virtual assets. The system includes at least one controller operative to (i) in response to input of a player identifier, identify a player at one of the plurality of gaming terminals, (ii) recall a player account associated with the player, (iii) recall a set of virtual assets associated with the player account, (iv) modify the set of virtual assets based upon the player's collection, redemption and disposition of virtual assets during play of the wagering game, (v) provide a monetary award to the player for any winning outcomes achieved during play of the wagering game; and (vi) store the modified set of virtual assets in the virtual asset server upon the player concluding play of the wagering game.

According to yet another aspect of the invention, a method of conducting a wagering game having virtual assets, comprises receiving at least one wager, displaying a wagering game on a plurality of gaming terminal displays, and storing (i) a plurality of player accounts, (ii) a set of virtual assets associated with each player account, and (iii) a master rule set for management of virtual assets, on a virtual server in communication with the plurality of gaming terminals. The method further comprises identifying a player at one of the plurality of gaming terminals in response to input of a player identifier, recalling a player account associated with the player, recalling a set of virtual assets associated with the player account, and modifying the set of virtual assets based upon the player's collection, redemption and disposition of virtual assets during play of the wagering game. The method further comprises providing a monetary award to the player for any winning outcomes achieved during play of the wagering game, and storing the modified set of virtual assets in the virtual asset server upon the player concluding play of the wagering game.

According to yet another aspect of the invention, one or more computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1A:
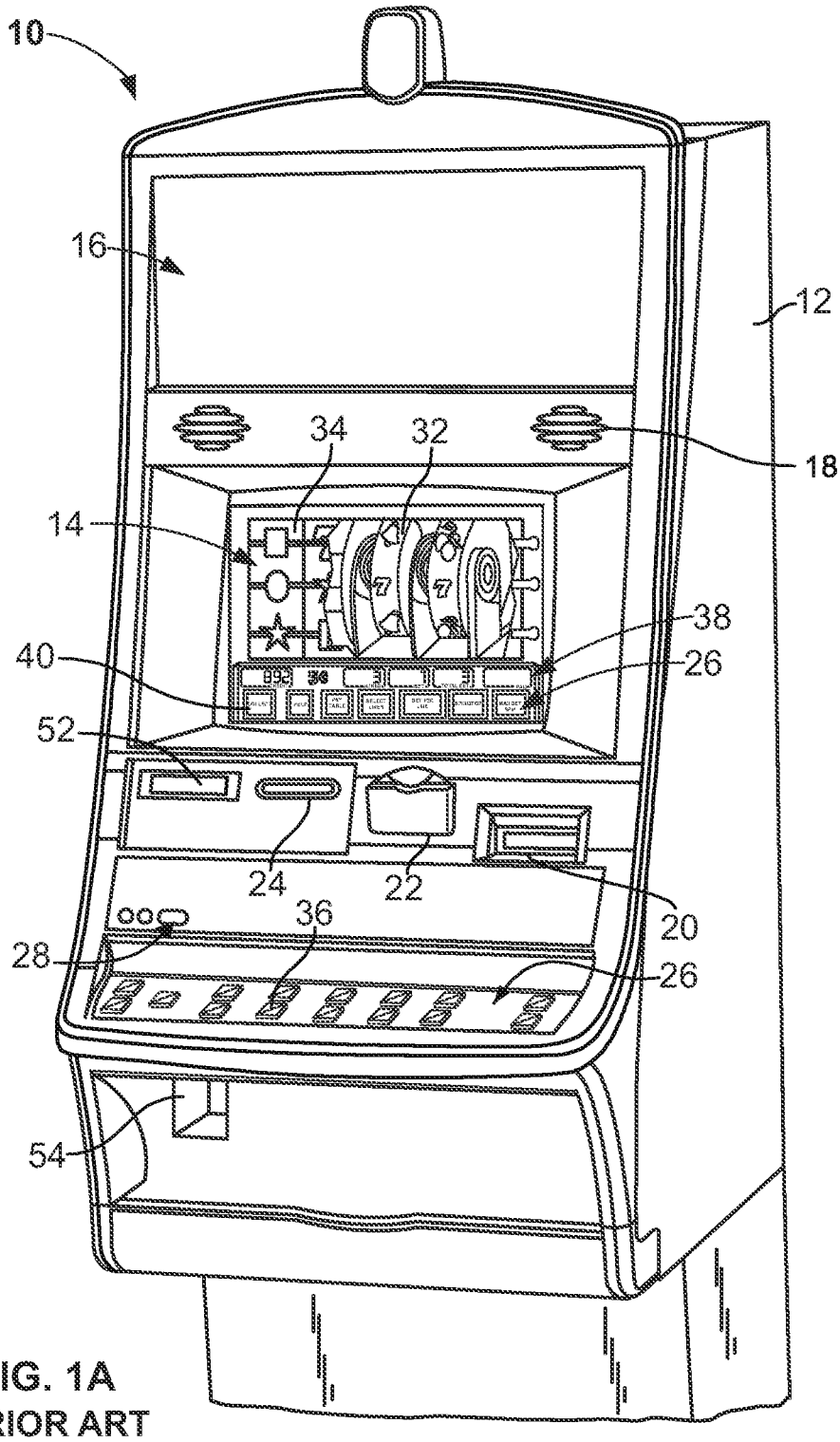
FIG. 1A PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
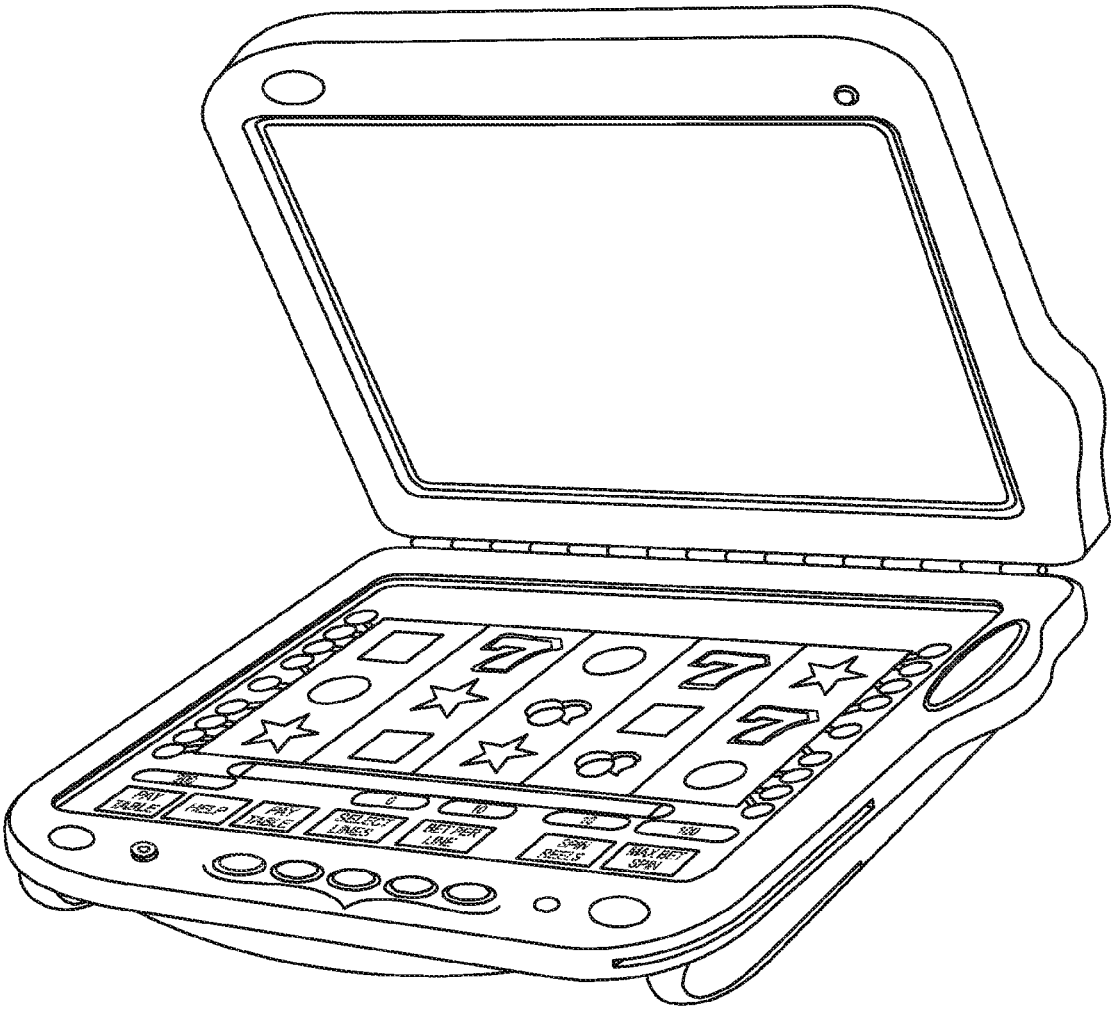
FIG. 1B PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
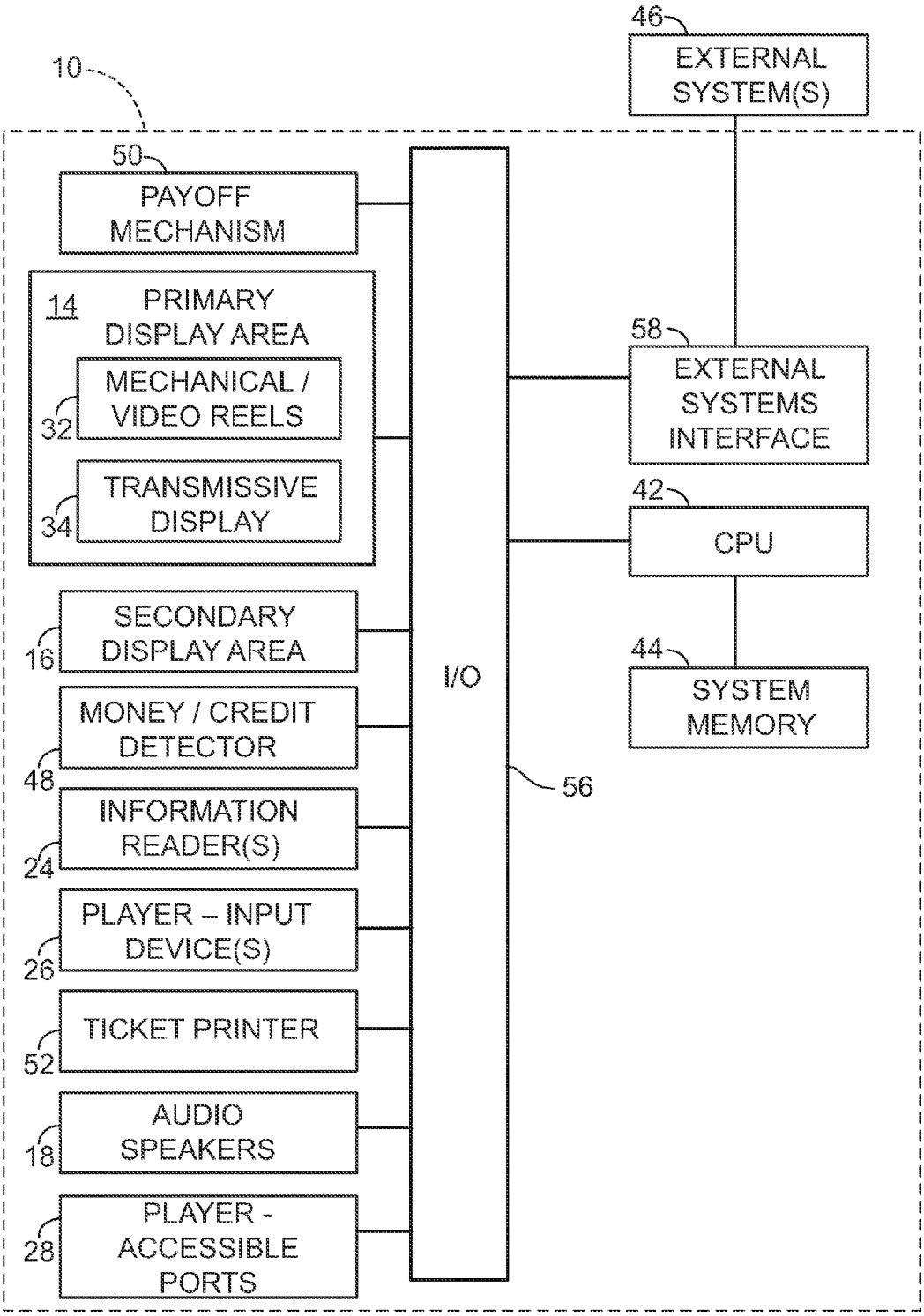
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10 bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
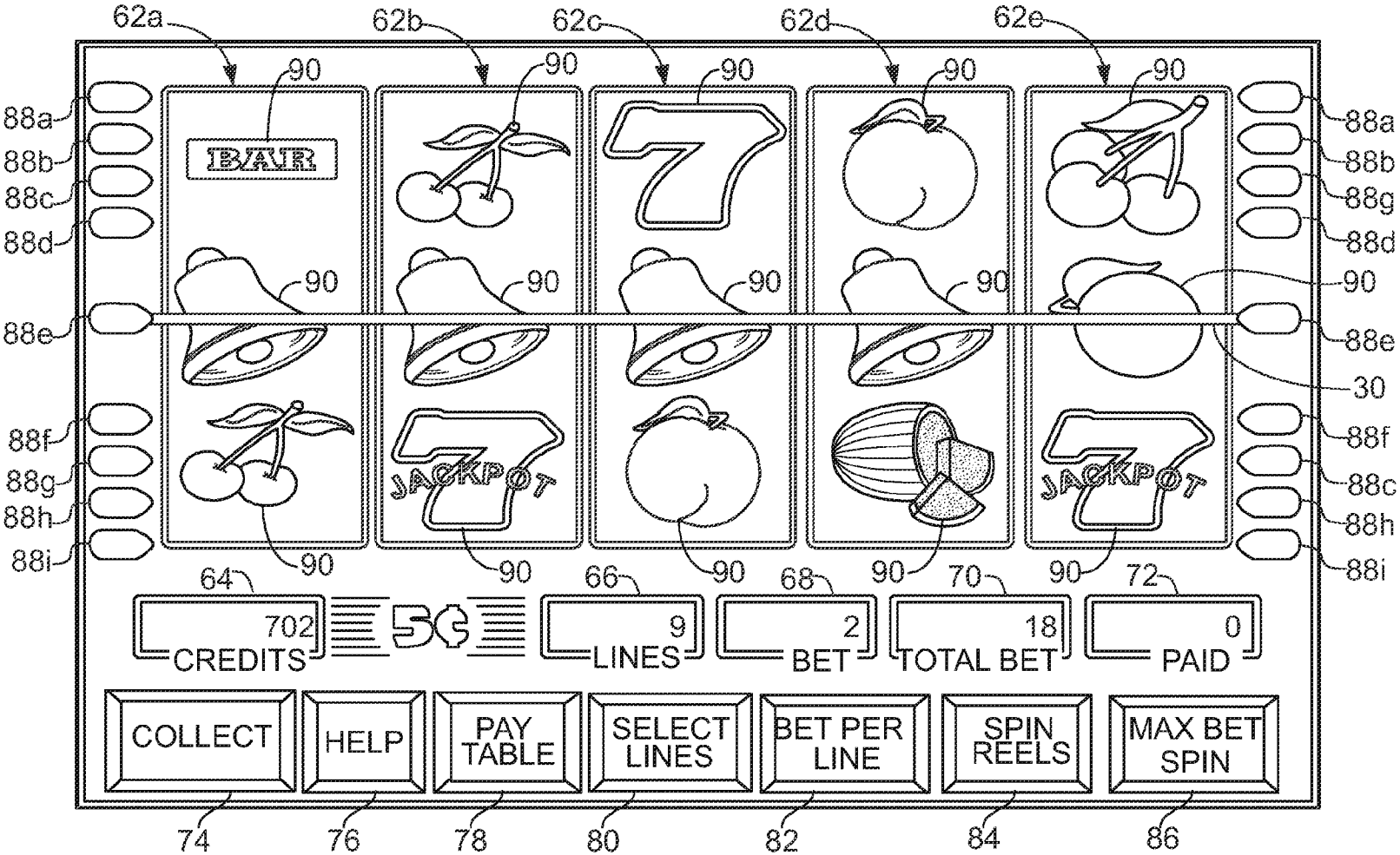
FIG. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
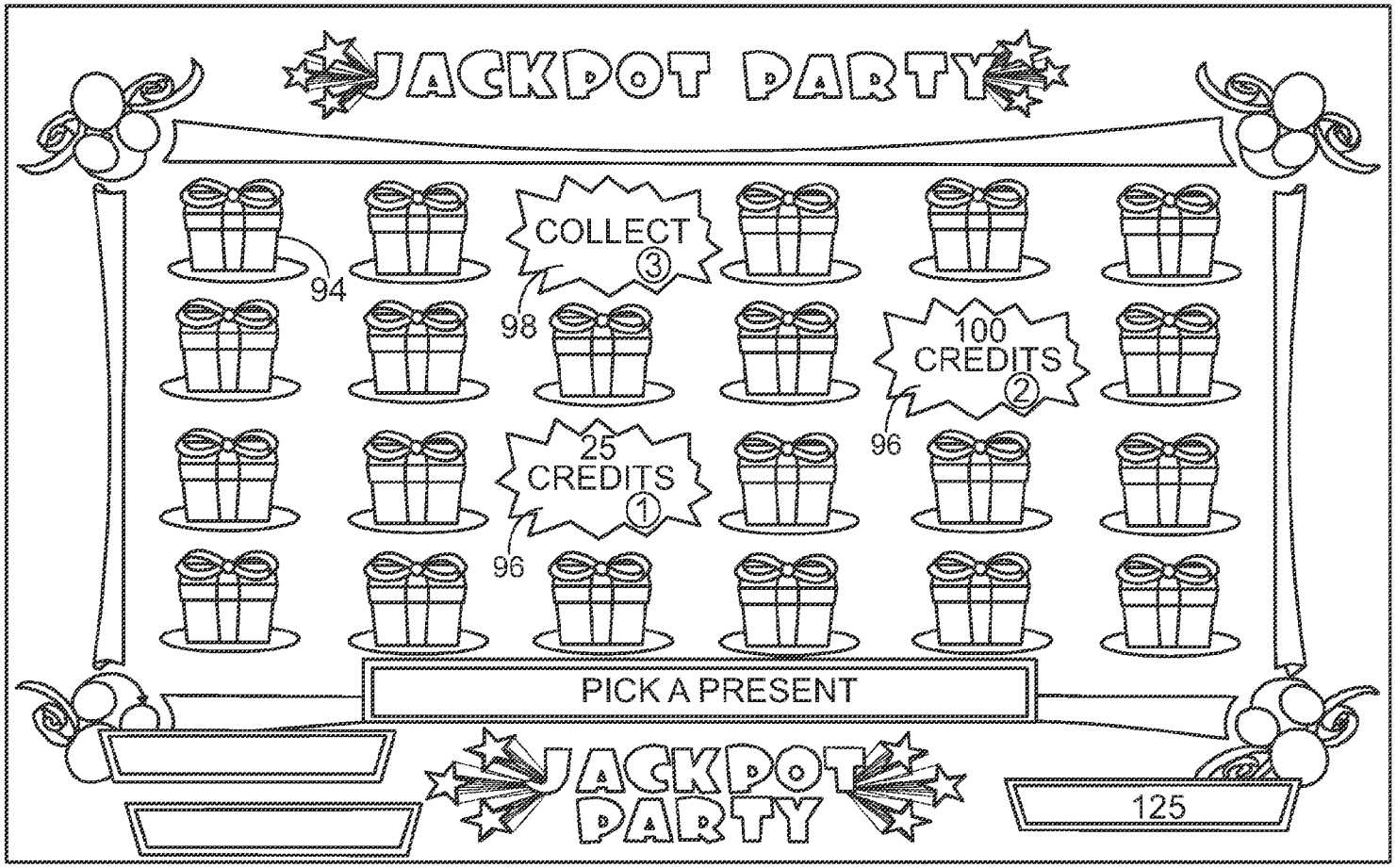
FIG.4 PRIOR ART
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
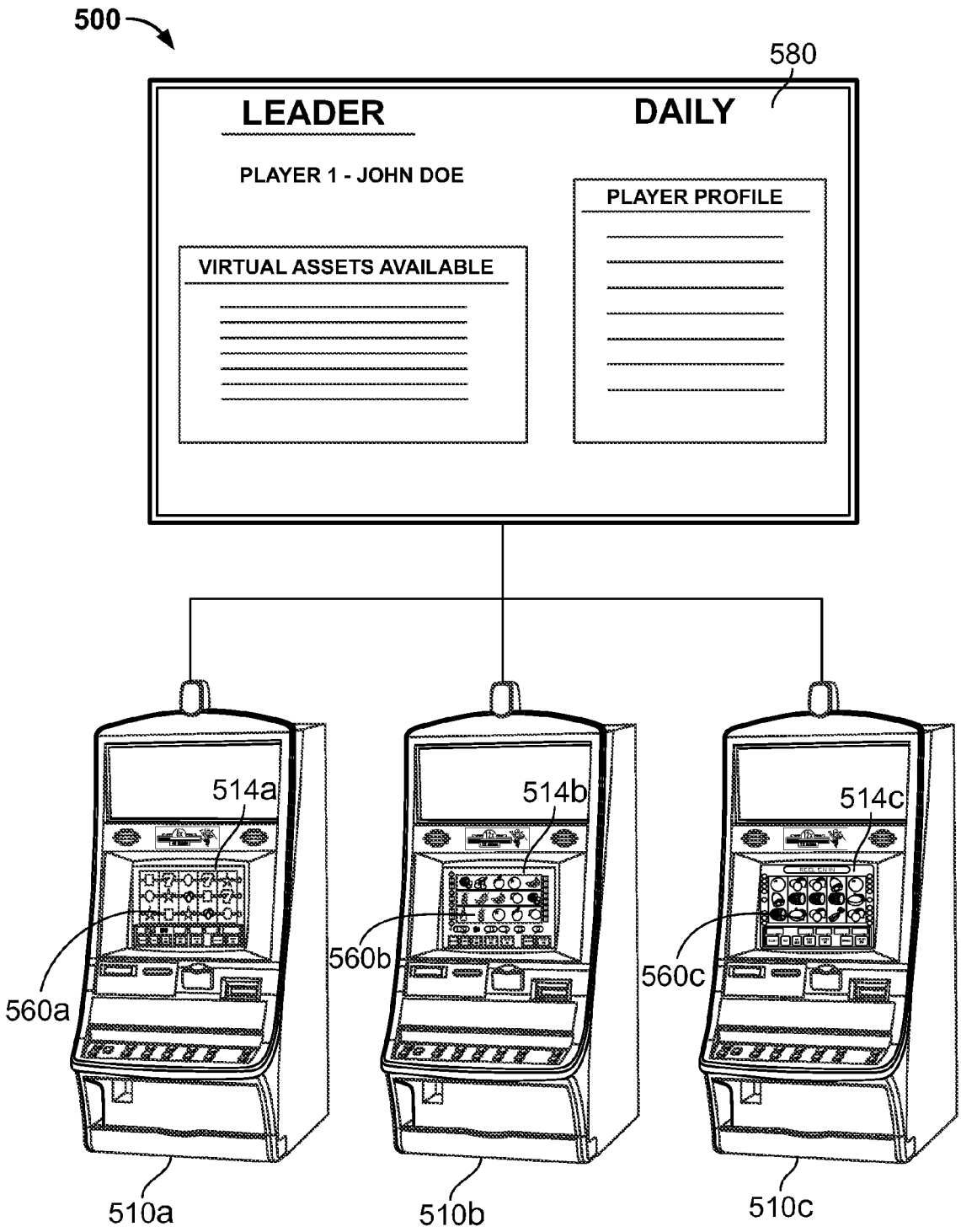
FIG. 5 is an image of a gaming system having virtual assets and achievements.

Turning to FIG. 5, a gaming system 500 including virtual assets, such as prizes and achievements, is displayed. The system 500 includes a plurality of gaming devices 510*a,b,c*, each of which include at least a primary display 514*a,b,c* for displaying game events thereon. Each of the primary displays 514*a,b,c* may be any form of display such as those described herein with reference to the free standing and handheld gaming devices of FIGS. 1*a* and 1*b*. The primary displays 514*a, b,c* may include a display of a primary wagering game 560*a, b,c*, which in this embodiment are slot games as shown in FIG. 5. The primary wagering games 560*a,b,c* may include a plurality of reels, which may be either electro-mechanical reels or simulations thereof on the primary display 514*a,b,c*. The reels may include a plurality of symbols thereon which vary as the reels are spun and stopped. The symbols may include any variety of graphical symbols, elements, or representations, including symbols which are associated with one or more themes of the gaming machine 510*a,b,c* or system 500. The symbols may also include a blank symbol, or empty space. The primary wagering games 560*a,b,c* shown on the various primary displays 514*a,b,c* of the system 500 may be the same, similar, or different in nature, game play, theme, denomination, formation, eligibility, etc.

As described herein, in some embodiments, symbols landing on the active pay lines (the pay lines for which a wager has been received) are evaluated for winning combinations. A combination of symbols that lands on an active pay line is a winning outcome for which an award may be paid in accordance with a payable of the gaming device 510*a,b,c* or system 500. The symbols on the reels form an array or matrix of symbols, having a number of rows and columns, which in the embodiment shown is three rows and five columns. In alternate embodiments, the array may have greater or fewer symbols, and may take on a variety of different forms having greater or fewer rows and/or columns. The array may even comprise other non-rectangular forms or arrangements of symbols. In alternative embodiments, other criteria may be used for winning combinations, such as symbol arrangement or configuration without regard to pay lines.

The system 500 further includes a community display 580, which in this embodiment is an LCD, plasma, or other flat-screen display mounted and positioned above the plurality of gaming devices 510*a,b,c*. The community display 580 may display a variety of information, including information relating to secondary or community events or bonuses. The community display 580 may further be configured to display information relating to awarding, accumulation, and collection of various virtual assets and achievements offered by the system 500, as described herein. For example, in one embodiment, the community display 580 may serve as a leader board, ranking display, or standing results display of various available virtual assets and achievements. The community display 580 may also be used to display social networking information as described further herein. Other configurations are possible. The display 580 may be configured to display information about any facet of virtual assets and achievements including which assets remain available, and events that are ongoing, have occurred or are going to occur. For example, players logged into the system 500 and their various virtual assets, achievements or prizes may be displayed. Winning and result histories may also be displayed on the community display 580. Moreover, player profiles, trophy rooms, and other information may be displayed on the community display 580.

The community display 580 may be placed in any appropriate place within a casino or operator's facility, for example, a gaming room in a casino, the entry area of a casino, elevators of a casino, or any other public place inside or outside of a casino. Publicly displaying virtual asset information creates a community environment so as to incentive players to engage in collection and redemption of such virtual assets. Players may discuss their results or the results of others. Seeing and discussing the results of others may create an environment of friendly competition in obtaining and achieving such virtual assets and achievements. This competition may spur some players to compete in more wagering game activities to collect virtual assets, which may foster an environment of community and competition and may also create player loyalty.

Figure 6:
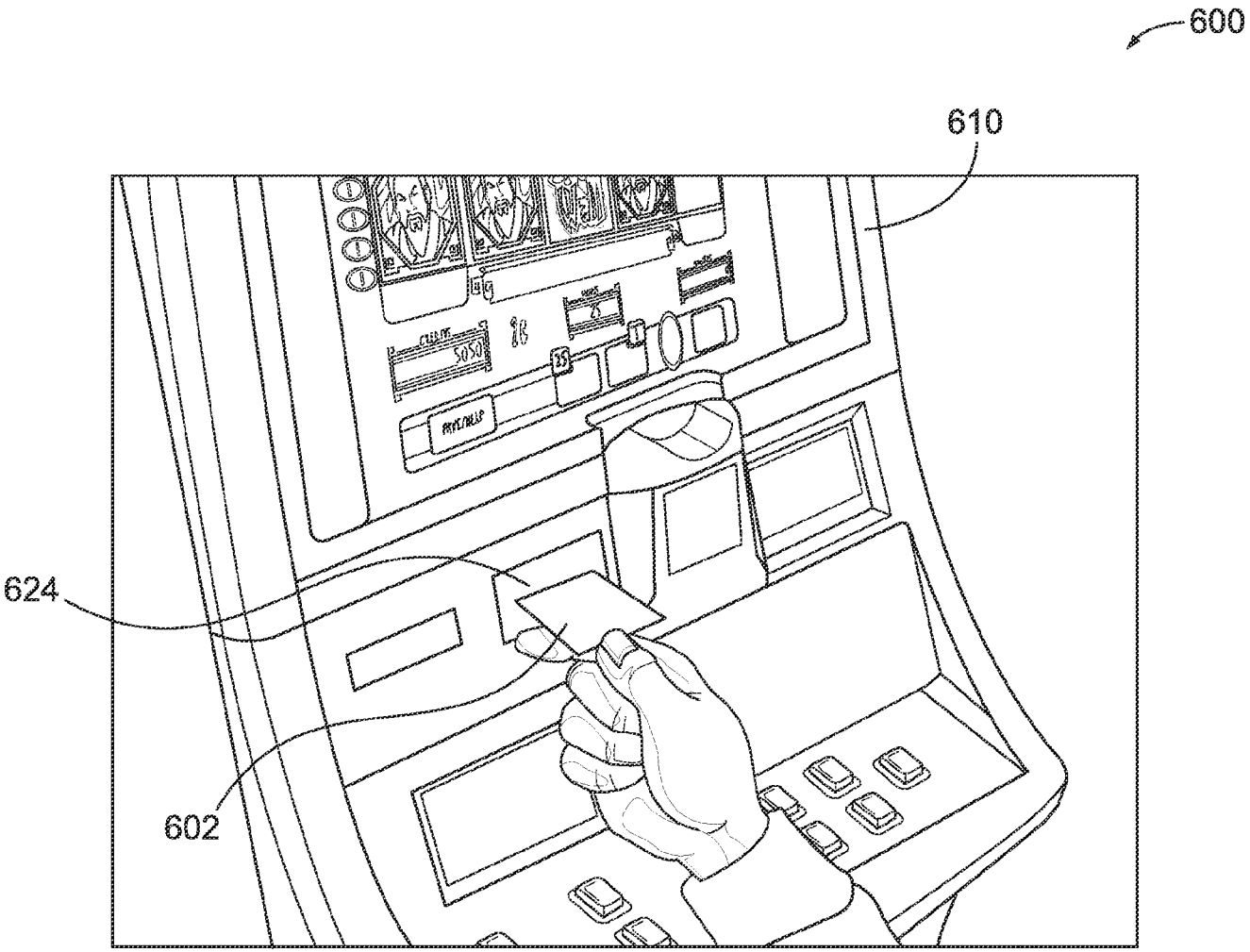
FIG. 6 is an image of a player inserting a player's card into a gaming terminal.

Turning to FIG. 6, depicted is a player inserting his player's card 602 into a card or information reader 624 of a gaming machine 610 of a gaming system 600. In an embodiment, the gaming system 600 having virtual assets and achievements administers the accumulation of such assets and achievements by identifying various players desirous of participating in gaming events. When a player inserts his player's card 602, the gaming system 600 identifies the player (for example by recalling a player account associated with a number stored on the card) and then tracks the player's game play, storing information related to the player's results in primary wagering games and progress in receipt, collection, and accumulation of virtual assets and achievements. In one embodiment, a player must have a player's card (or other player identifier as described herein) in order to participate in collection of virtual assets and achievements as described herein, which are offered by the system 600.

In this embodiment, the player's card 602 may contain a player identifier, and may also contain or be associated with player preferences and virtual asset status information. The player identifier may be a player name, or some type of player number, symbol, or alphanumeric string that uniquely identifies the player. Once a player is identified via his identifier, associated player preferences and virtual asset status information may be recalled or downloaded by the system to the local gaming terminal 610 on which the player is playing. Player preferences may include machine settings a player may prefer when playing a game, such as, for example, whether buttons should be arranged for a left-handed player or a right-handed player. Many other player preferences may be stored and recalled as well, such as color schemes, themes, graphics, animations, sounds, wager information, pay line configurations, etc. Virtual asset status information may include information relating to the various levels of achievements collected by the player, virtual trophies currently held, game history information, achievement history information, etc. A variety of other player preferences and/or virtual asset status information may be associated with the player identifier and recalled or downloaded when the player card (or other identifier) is inserted.

Figure 7A:
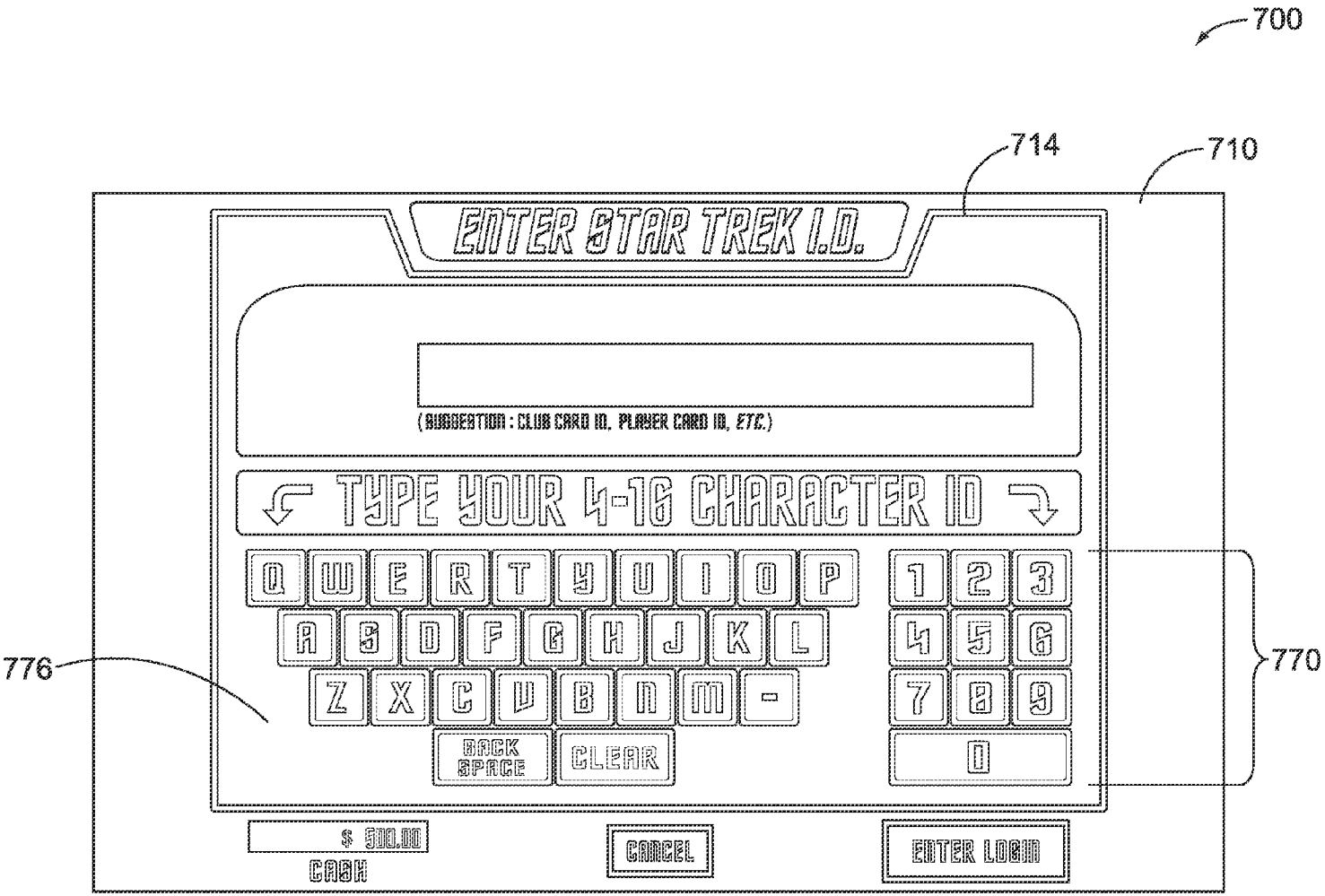
FIG. 7*a* is a screen shot of a player logging into a gaming system using a user name and password.
Figure 7B:
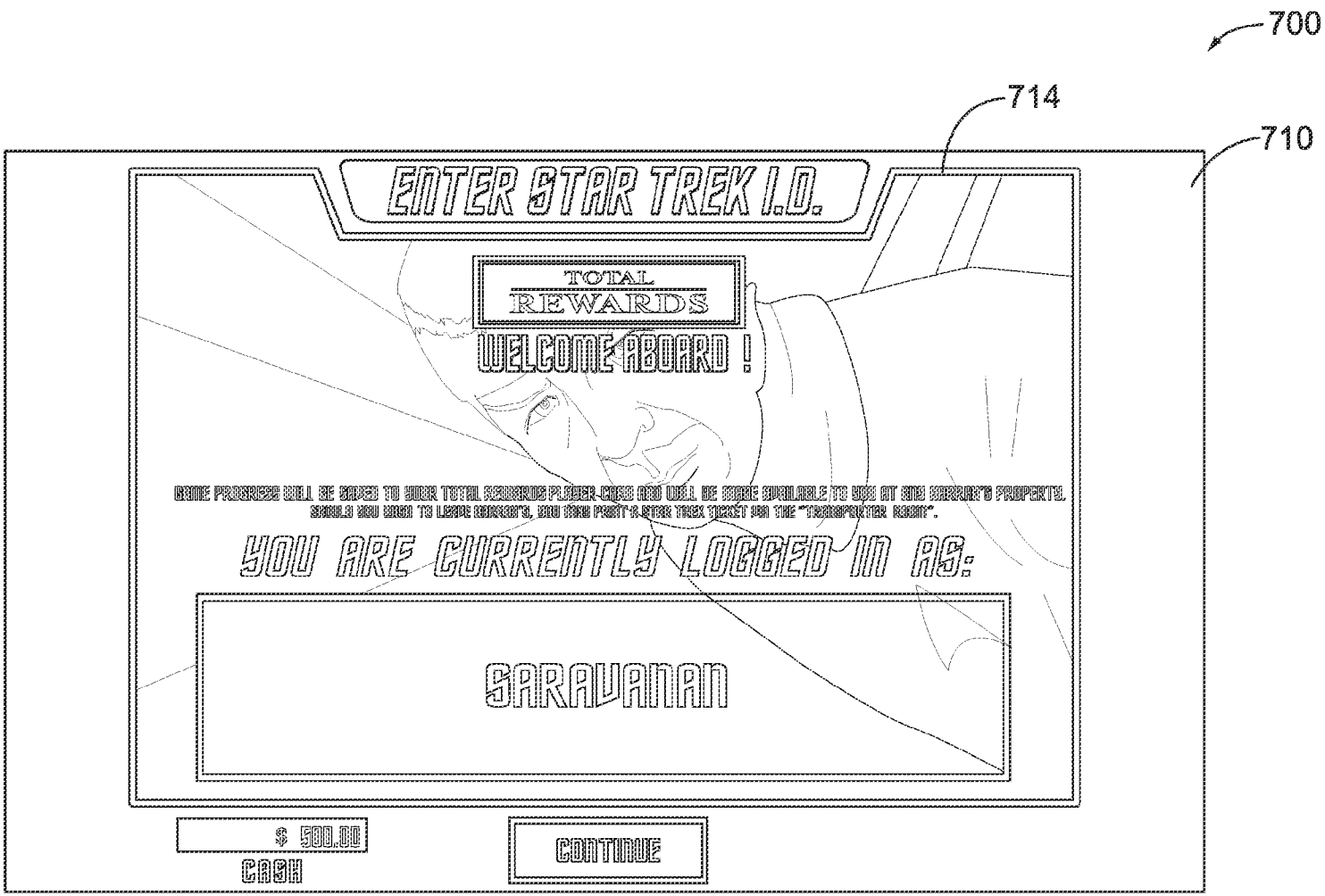
FIG. 7*b* is a screen shot showing the player having completed the login process.

In FIG. 7*a*, an alternate display 714 of a gaming terminal 710 of a gaming system 700 having virtual assets and achievements is displayed. In this embodiment, instead of inserting a player card, the player logs into the system 700 by using a username and password. Thus, by using an appropriate input device, such as a keyboard 774 or touch screen 776 overlying the display 714, the player inputs an assigned username and password which recalls a player account associated with the player, much like the player card recall of an account described with reference to FIG. 6. Once the player account is recalled, player preferences and virtual asset status information can be similarly recalled and loaded into memory where it is available for use within game play, as described herein. As seen in FIG. 7*b*, the player has completed the login process and the player's name is recalled and displayed on the primary display 714 to indicate to the player that his login has been recognized.

Figure 8:
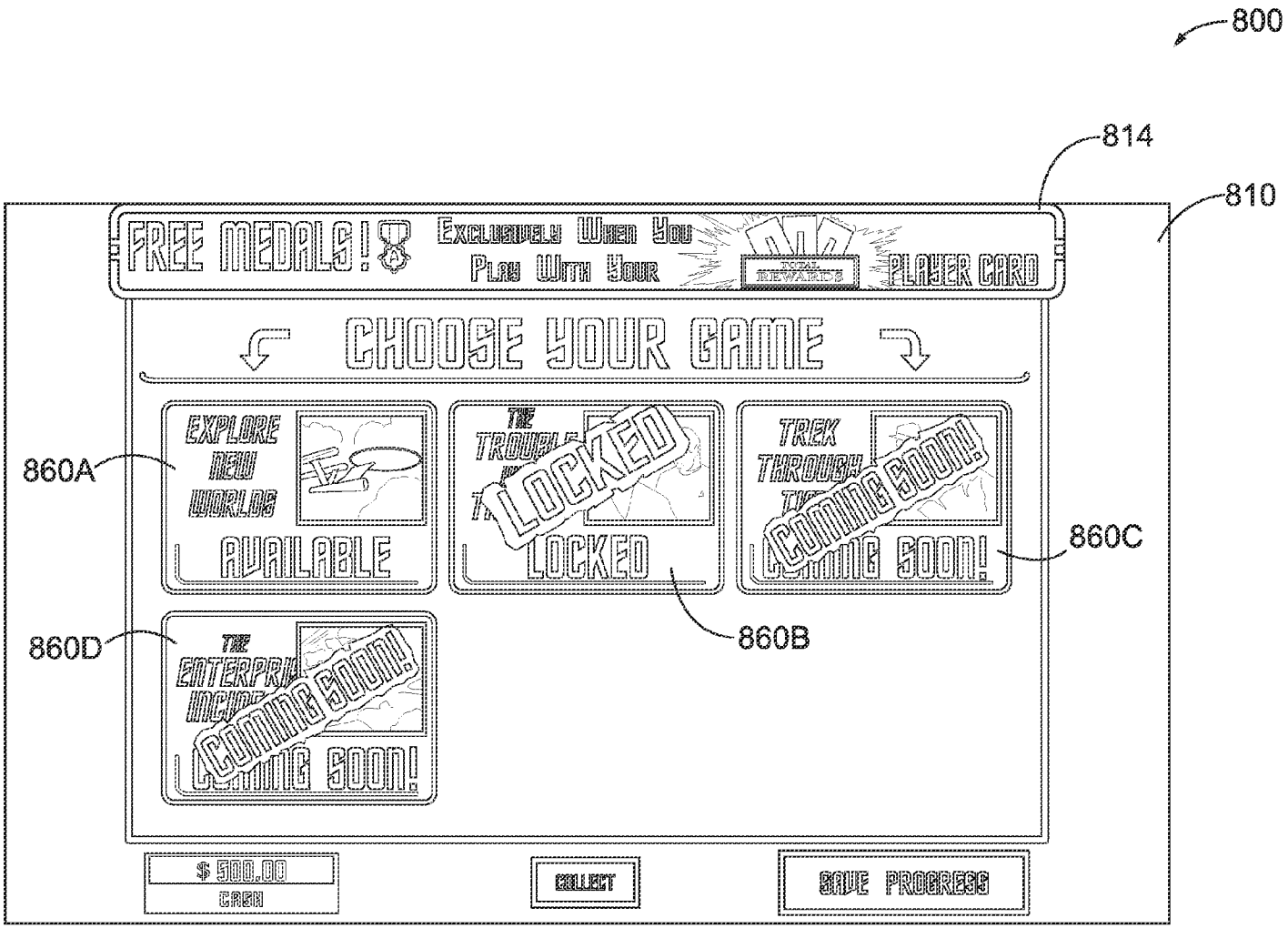
FIG. 8 is a screen shot of a selection screen providing a plurality of wagering games or episodes from which a player must choose.

Turning to FIG. 8, a primary display 814 of a gaming terminal 810 of a gaming system 800 having virtual assets and achievements is displayed. FIG. 8 depicts a selection screen which the player may encounter, for example after logging into the system 800 via a player card (e.g. FIG. 6) or username and password (e.g. FIGS. 7*a* and *b*). Once logged in, the player may be permitted to select from a variety of wagering games 860*a,b,c,d* or various episodes or versions of a wagering game theme. In FIG. 8, four episodes 860*a,b,c,d* of a Star Trek themed wagering game are displayed. Two of the episodes 860*c,d* are labeled "Coming Soon" to indicate that they are not yet available for play, but will be provided on the system 800 shortly. A third episode 860*b* is labeled "Locked" to indicate that the episode of the game is available on the system 800, but that the player is not eligible to play that episode 860*b*. This may be due to a variety of eligibility criteria, at least one of which the player does not satisfy. In an embodiment, the player cannot play the "Locked" episode 860*b* due to an insufficient accumulation of virtual assets or achievements, such as medals, as described further herein. In other embodiments, other deficiencies in eligibility or non-compliance with one or more rule sets may cause the episode 860*b* to be "Locked." A fourth episode 860*a* is available and open for play to the player, and thus is labeled "Available." In this example, the player selects the "Available" episode 860*a* to commence play.

Figure 9:
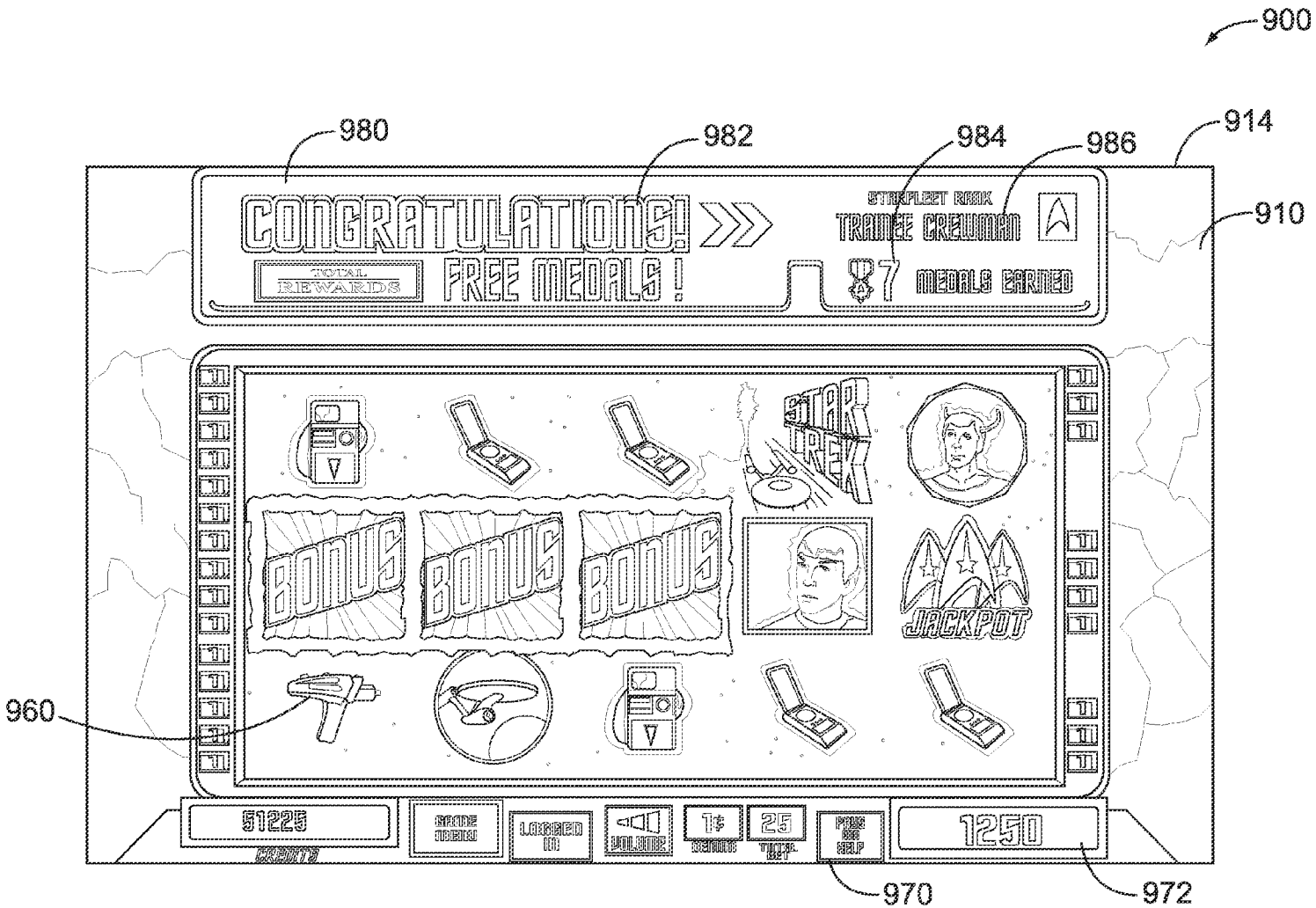
FIG. 9 is a screen shot of a primary display of a gaming system displaying primary wagering game and a virtual asset information bar.

Turning to FIG. 9, depicted is the primary display 914 of a gaming terminal 910 of the gaming system 900 during play of the selected episode of a wagering game 960, wherein the gaming system 900 includes virtual assets. In addition to the wagering game 960, the primary display 914 includes an asset information bar 980. The asset information bar 980 displays virtual asset related information, and includes an asset notifier 982, an asset counter 984, and an asset status field 986. The asset notifier 982 is used to inform the player of the occurrence of an award of a virtual achievement or prize. As seen in FIG. 9, in this instance the notifier 982 indicates to the player "Congratulations! Free Medals!" since the asset in this embodiment are achievements called "medals." The asset counter 984 is updated to reflect that the player has earned a total of seven (7) medals or achievements. In this embodiment, accumulation of seven medals is associated with a level or rank of "Trainee Crewman" as seen in the asset status field 986. Other information regarding the earning, collection and accumulation of medals or achievements can also be displayed in the asset information bar 980. In some embodiments, only certain players will be eligible to receive free medals such as that depicted in FIG. 9. For example, in one embodiment, only players who have inserted a players card are eligible for free medals, while players logging in with a ticket, username, password, or other identifier may still earn medals through game play, but may not receive free medals, which are reserved for carded players.

In this embodiment, the player plays the wagering game 960 in typical fashion—by entering wagers and pressing a spin button, for example, to initiate a play of the wagering game 960. A winning combination of symbols in a randomly selected outcome comprises a winning outcome for which credits are paid in accordance with a payable. As seen in FIG. 9, a winning outcome has occurred and the player has won 1250 credits. A control panel 970 located along the bottom of the primary display 914 includes a credit meter 972 which informs the player of the 1250 credit win. However, in addition to being awarded a cash value prize in the form of credits, the player also earns at least one virtual asset or achievement, which in this embodiment is a medal. As indicated, the occurrence of the medal win is displayed in the asset information bar 980. In some embodiments, virtual achievements and prizes, such as the medal, have no cash value to the player (i.e., they are not redeemable for cash, credits, or currency of value). Instead, the medals or achievements are intangible assets which give the player a non-cash improvement. For example, the achievements may increase the player's rank or level seen in the status field 986, which may in turn allow the player to receive improved graphics, audio, customization features, or other improvements to their gaming experience as described in detail further herein.

Figure 10:
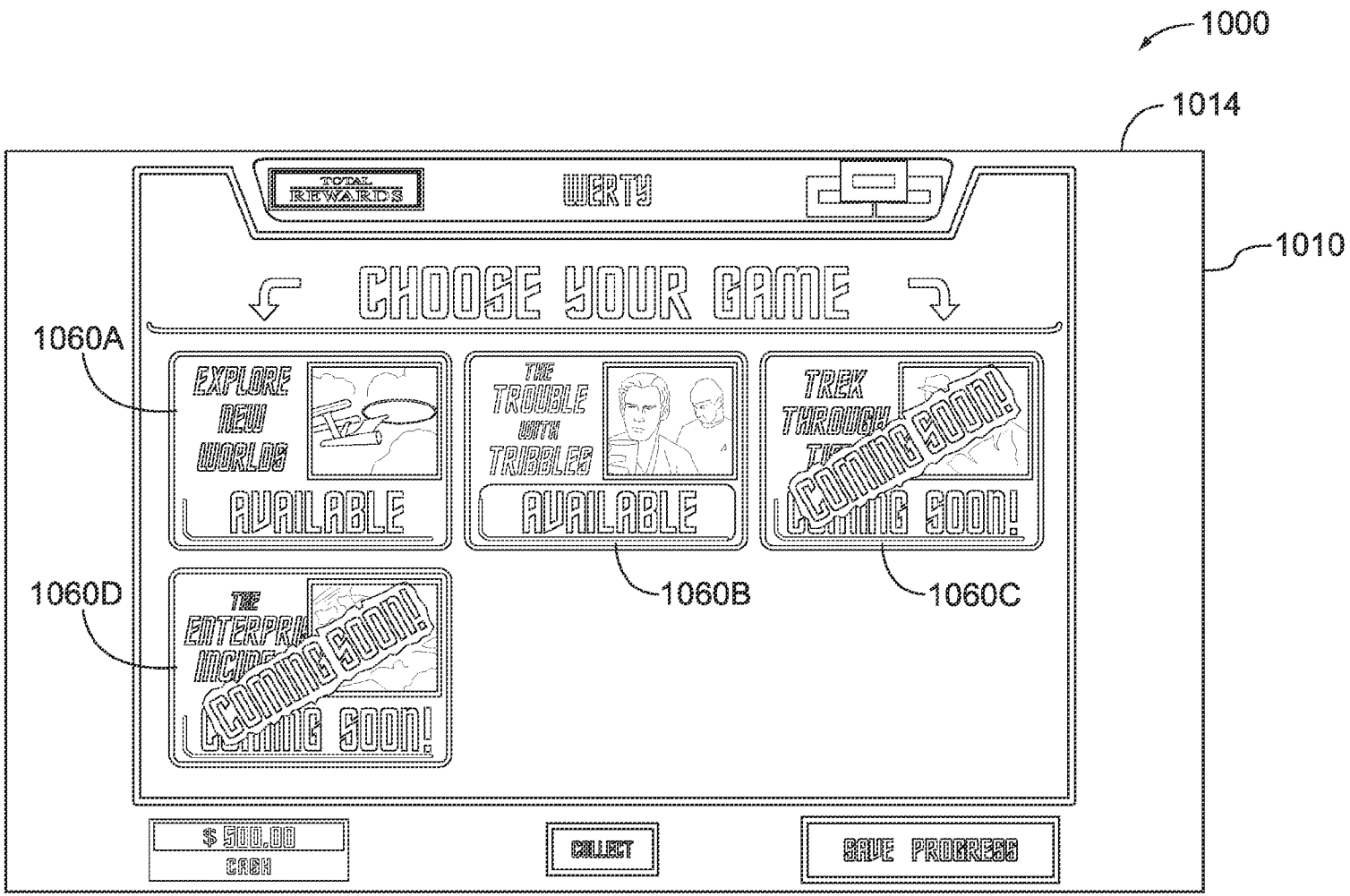
FIG. 10 is another screen shot of the selection screen of FIG. 8 in which additional selections are available to a player.

Turning to FIG. 10, the primary display 1014 of a gaming terminal 1010 of the gaming system 1000 once again displays a selection screen, similar to the selection screen of FIG. 8. Because the player has collected additional virtual asset (in this case achievements in the form of medals) during play of the wagering game, as seen in FIG. 9, the player has now achieved additional or improved eligibility. The second episode 1060*b*, entitled "The Trouble with Tribbles" which was previously locked (see FIG. 8) is now "Available" to the player due to his improved eligibility. Thus, as indicated, in some embodiments, collection of a sufficient number and/or type of virtual assets, achievements or medals can unlock new episodes or higher levels of wagering games.

Figure 11A:
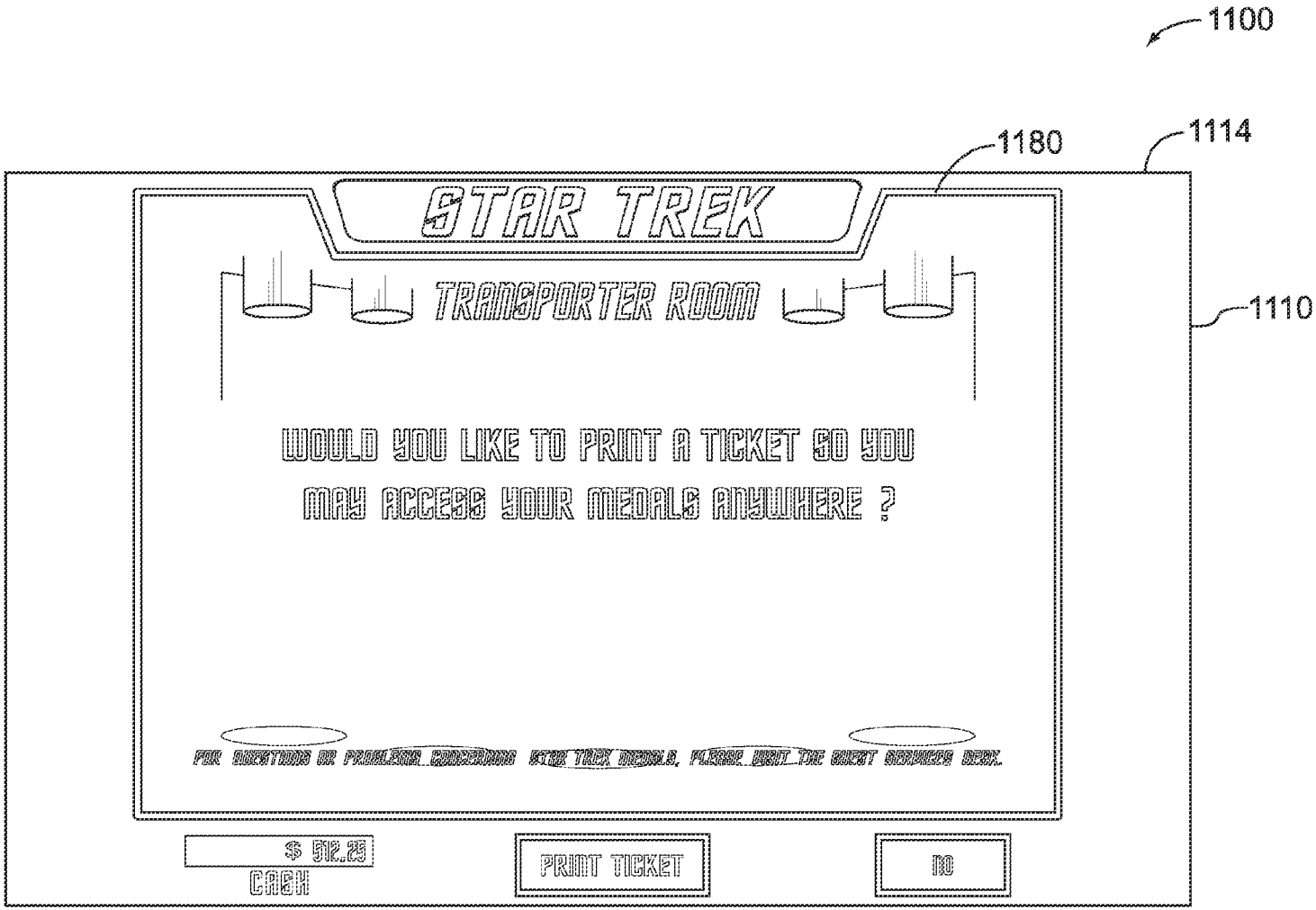
FIG. 11*a* is a screen shot of an account management screen in which a player may choose to print a ticket.
Figure 11B:
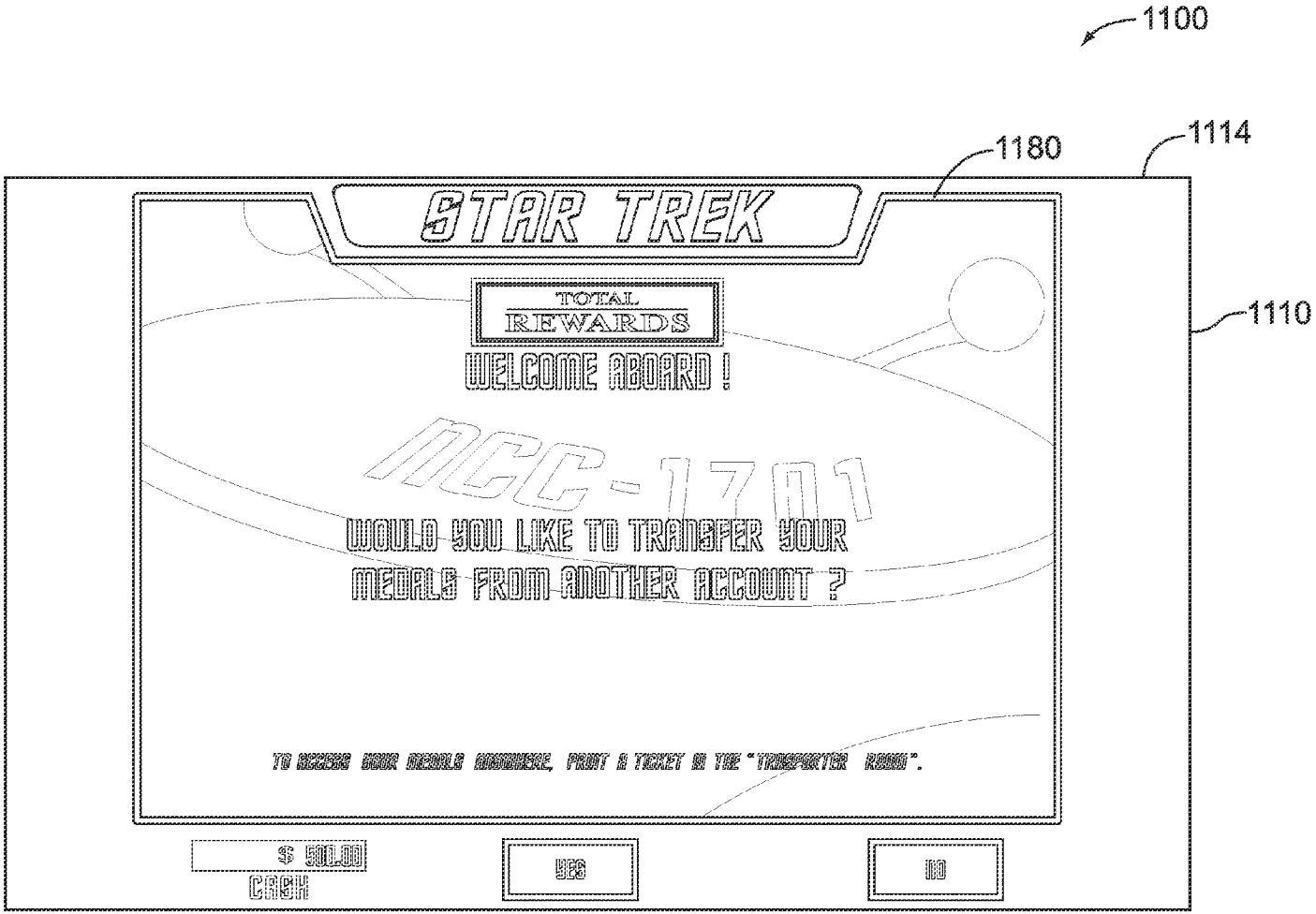
FIG. 11*b* is a screen shot of an account management screen in which a player may choose to transfer virtual assets between accounts.

Turning to FIGS. 11*a* and 11*b*, a primary display 1114 of a gaming terminal 1110 of a gaming system 1100 displays an account management screen 1180 where a player may manage virtual achievements and medals earned during game play. For example, in FIG. 11*a*, upon concluding a gaming session, a player may elect to print a ticket having an identifier thereon so that the player's virtual assets and/or achievements are portable and usable on another gaming terminal, elsewhere in the casino, in a different casino, or via the internet from a remote location. In an embodiment, the ticket printed for the player contains an identifier in the form of a bar code which can be read by an appropriate bar code reader in communication with such other device. In other embodiments, the ticket may include an alphanumeric code, string, or other identifier which can be input or read into a subsequent device such as the player's virtual asset, prize or achievement information may be recalled and used. In FIG. 11*b*, a player may utilize the account management screen 1180 to import virtual achievements from other accounts, or transfer such assets between accounts. For example, a player having multiple player accounts may consolidate virtual trophies, achievements, medals, etc. onto a single account, or transfer such assets between accounts.

Figure 12:
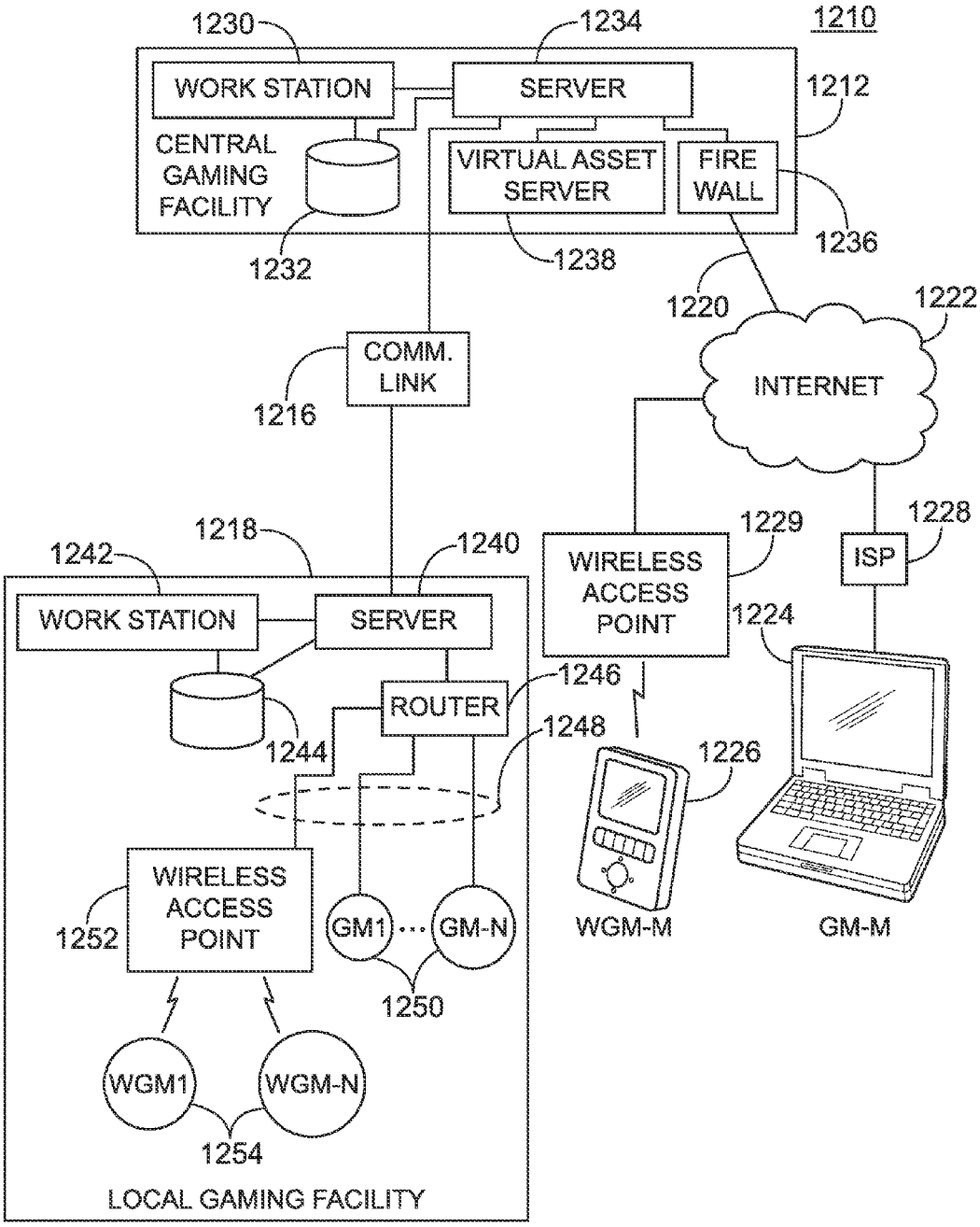
FIG. 12 is a diagram of an example gaming system including a virtual asset server for administering virtual assets and achievements.

Turning to FIG. 12, a diagram of an example gaming system 1210 having virtual prizes and achievements is depicted. Shown in FIG. 12, is an exemplary gaming system 1210 which includes a central gaming facility 1212 connected by communication link 1216 to a local gaming facility 1218, e.g. a casino, and by link 1220 with the internet 1222. End user computing devices including a gaming machine or terminal GM-M 1224, e.g. a laptop computer, and wireless gaming machine or terminal WGM-M 1226, e.g. a personal digital assistant (PDA), function as clients of the central gaming facility 1212. Laptop 1224 is coupled via internet service provider 1228 and the internet 1222 with the central gaming facility 1212. The PDA 1226 is connected with a wireless link by the wireless access point 1229 and internet 1222 to the central gaming facility 1212. As used herein, "gaming" refers to the use of various games that support the placing of wagers on the outcome of the games, e.g. a video poker machine.

The central gaming facility 1212 may represent a control location of a gaming business operator that supports individual gaming users, e.g. users of PDA 1226 and laptop 1224, as well as other gaming facilities of the operator such as casino 1218. The central gaming facility 1212 in this illustrative example may be geographically separated from the casino 1218 and the individual users. The central gaming facility 1212 includes a workstation 1230 supported by data storage element 1232 and a server 1234 that serves as a communication host for casino 1218 and the individual users via firewall 1236. Requests for information and/or data received from the individual users are processed by server 1234. The requested information and/or data may be obtained from support resources, e.g. workstation 1230 and data residing in storage element 1232. The requested information is sent from the server 1234 to the requesting user's devices.

The local gaming facility 1218 represents a casino and includes a server 1240 supported by a workstation 1242, data storage element 1244 and a router 1246. The router 1246 supports communications with different gaming machines or terminals GM(1)-GM(N) 1250 by wired links 1248. A wireless access point 1252 is connected by a wired link 1248 to router 1246 and by wireless communication links to wireless gaming machines or terminals WGM(1)-WGM(N) 1254.

At least some of the gaming machines 1250 and some of the wireless gaming machines 1254 support the play of wagering games in which the user's gaming machine functions in the client/server communication model with the user's gaming machine being a client of server 1240. The user's gaming machine contains software which is responsible for the ongoing play of the wagering game. However, some information or data associated with the play of the game may be obtained during the ongoing play of the game from server 1240. Thus, the gaming system 1210 displayed and described may be configured to execute and display a variety of primary wagering games and community or progressive wagering games on the terminals [GM(1)–GM(N) 1250, WGM(1)–WGM (N) 1254, GM-M 1224, and WM-M 1226], as explained further herein.

As seen in FIG. 12, the central gaming facility 1214 may also include a dedicated virtual asset server 1238 for managing the awarding, collection, accumulation, and redemption of virtual assets, achievements and prizes. The virtual asset server 1238 may be separate from or integrated with the server 1234, or other servers of the facility 1212. The virtual asset server 1238 and/or workstation 1230 include software which operates to control, manage, execute, and operate the available virtual prizes, achievements, and medals as described herein. For example, such software may log in users to the system, detect and catalog their receipt of and collection of various virtual achievements and prizes, manage eligibility of such players to participate in game play based upon such player's accumulation of achievements, and track player's progress. The virtual asset server 1238, for example, may permit players to access a player history file or profile to see past achievements earned, virtual prizes and medals redeemed or expired, past results, etc. The virtual asset server 1238 may provide access to players within a casino or gaming facility over link 1216, or may otherwise provide access to players remote from the gaming facility, for example over a home or mobile computer via link 1220. It should further be understood that any of the functions described herein as relating to the central gaming facility 1212 may alternatively or additionally be performed at the local gaming facility 1218, or by any computer or server in communication therewith.

The system 1200 depicted in FIG. 12 may also include operation of a social networking facility, for example, via the server 1240 or other hardware and software. By allowing gaming players to access the server 1240 via the internet, for example, the system 1200 offers an online community that enables players to extend their player experience beyond a physical casino or operator's facility. The system's external components which may support a social networking website, for example, provide an arena for wagering game players to communicate, discuss, interact, and engage in an online lifestyle or community, which in turn can fuel demand for particular wagering games, themes, episodes, features, etc. Dissemination and collection of virtual assets, prizes, and achievements further fuels such an online community by providing intangible assets which can form the basis of bragging rights, competitive behavior amongst players, and interest in wagering games. In this way, the use of virtual assets, achievements and prizes may create or foster a virtual economy in which the virtual assets (such as medals) form the basis of the economy and can be traded, change in value, earned, collected, redeemed, upgraded, etc, as described herein.

Within the social networking aspect supported by the system 1200, each player may be assigned a player account, which may have associated therewith ancillary information such as a player profile. The player profile may include a variety of information related to the player, including preferences as to game play. The player profile may also be the location in which such player's performance, game history, and collection of virtual assets is tracked, stored, and displayed. Thus, a player's collection and accumulation of virtual assets may be stored in the player's profile for easy recall. The player (and other authorized personnel) may access the player's profile via any appropriate device, including one or more gaming terminals within a casino or operator location, a gaming device remote from the casino, other terminals in communication with the central gaming facility, mobile devices, or other computers via the internet or other external links, including for example a home computer or laptop. The player profile provides a link between the social networking aspect of the system and the gaming aspects of the system. A player may also have other visual interfaces for viewing collection of assets. For example, via the social networking or gaming interfaces, a player may also have a virtual trophy room where achievements and other assets may be visually displayed, stored, or cataloged. Other interfaces may be used through which assets are stored and displayed.

In some embodiments, a variety of different types of virtual assets may be used, awarded, collected, and redeemed within such a virtual economy, including the achievements described herein. The various assets are associated with a variety of different attributes which govern the way the assets may be collected, redeemed, distributed, earned, etc. For example, the various attributes of the assets may include characteristics such as whether or not a collected asset is persistent or consumable, whether the asset can be bought, sold or traded, whether the asset is associated with any expected value within play of a wagering game, and whether or not the asset has any virtual value, and if so, whether such value is fixed or governed by a market value.

Table 1 below lists a variety of types of virtual assets which are available to be earned within an embodiment of the gaming systems described herein, as well as an example of attributes associated with such assets:

TABLE 1

| | Attributes | | | |
|---|---|---|---|---|
| Virtual Asset Type | Persistence | Buy/Sell/Trade | EV | Virtual Value |
| Achievements | Yes | No | None | None |
| Things | Consumable | Allowed with points | Allowed | Market |
| Keys | Consumable | Allowed with points | Allowed | Market |
| Points | Yes | Buy with cash | Fixed | Fixed |

In one embodiment, four categories of virtual assets are capable of being transacted: achievements, things, keys, and points, each having various attributes as seen in Table 1. Achievements may be visual items such as ribbons, trophies, or other graphical representations which are persistent items awarded for an accomplishment or event. Achievements may be awarded to individual players or groups of players. One or more rule sets govern the awarding of achievements, and thus, such rule sets governs whether or not an achievement is awarded to a group or individual player. If an achievement can only be obtained through a group then a player would need to complete specified criteria to be part of the group and thus eligible for receiving the achievement.

Achievements may be visually depicted as medals, trophies, awards, etc., or as icons or other three dimensional objects that are easily recognized by players, and designed to provide a visual cue as to the experience of a person within the gaming or social networking communities. Achievements may further be implemented as widgets that have behavior or embedded links. Achievements may be syndicated and may appear in multiple locations or forms associated with a player or group. For example, some achievements may appear on the player's profile as well as in their trophy room. Since achievements may also be awarded to groups or based upon a collective group's activity there may be a category of achievements for groups. Group achievements may appear in all of the player's trophy rooms or profiles that are part of the group, or only within a predetermined subset of the group, for example a leader or captain of the group. There may be a section designated for group achievements in the trophy room where these things would reside.

In an embodiment, and in accordance with the attributes seen in Table 1, achievements are personal or group mementos and cannot be purchased, sold or traded. They have no expected value (EV) and they have no virtual value (i.e. in points). However, achievements may be awarded simultaneously with payouts. For example, a royal flush on a casino video poker game would result in a payout and the award of a Royal Flush Achievement. In another example, a Top Award Achievement may be provided in conjunction with a player achieving a winning outcome on a slot game which is a top award on the pay table of such wagering game.

In an embodiment, achievements fall into three primary categories: Game Accomplishments, Events, and Collections. Game Accomplishments are achievements awarded by a casino or online game for an unusual win or for reaching an in-game goal. Examples might include getting a royal flush in a video poker game; completing an episode of a wagering game; playing an online game for a number of hours or other predetermined time; solving a mystery puzzle online; or hitting the top payment in a slot game. The rules for issuing Game Accomplishments may be stored locally, for example in memory of the individual wagering game terminals themselves. Any particular wagering game may award many different accomplishments. Event achievements may be awarded for participating in events. For example, a Casino Opener achievement may be awarded for playing at a designated new casino within the first ninety days (or other predetermined time) after opening. Note that the primary distinction for an Event Achievement is that it is not awarded by a particular game, but rather is based on the associated event. The Casino Opener achievement described above would be given for playing any game at the new casino within the predetermined time frame. Thus, the rules and mechanisms for issuing Event Achievements may reside centrally in the system, for example in the central gaming facility or other network component centrally accessible.

Collections achievements may further be awarded for collecting combinations of other Achievements. For example, a player may be given a special achievement for participating in five different casino openings. As with the event achievements, the rules and mechanisms for issuing Collection Achievements may reside and be administered centrally, for example by the virtual asset server, rather than in the individual wagering games or terminals. The term Advancing Achievement refers to a type of achievement where a new, higher level achievement replaces a previous, lower-level achievement. For example, in an episodic wagering game, such as the Star Trek game displayed and described with reference to FIGS. 8-10, the player advances from the rank of Ensign to Commander. In this case, the player does not collect two different achievements but rather collects a single achievement that advances with play.

Another form of virtual asset, as seen in Table 1, is referred to as a thing. "Things" is the generic term for virtual objects that can be purchased, traded or sold within the described virtual economy. Things have value in the virtual economy, and in an embodiment, such value is denominated in points, as described herein. One attribute of things are that they may also have an associated Expected Value (EV), which is held as a mystery until the object is consumed. Note that EV must always be funded from a funding source. For example, an object such as a thing may be awarded by a game and is funded by an award, or a part of an award, in accordance with the pay table of the game. Awarding EV to an object (such as a thing) may constitute a deferred win or award that is hidden from the player, yet preserved in the virtual asset, in this case the thing.

The EV of an object or thing is distinct and separate from the object's virtual points value. For example, a game might award a Blue Mystery Present with an in-game EV of $1.00. The EV is hidden from the player. The player may decide to sell the Blue Mystery present to another player for 75 Points. Thus, the EV is determined by the funding source (in this case the wagering game) while the virtual points value is determined by the virtual market administered by the system as part of the gaming and social network environment. Things may be awarded simultaneously with traditional payouts and credit awards, or independently thereof. For example, a bonus on a slot game may result in a payout and the simultaneous award of a key for an online casual game. Things may be persistent or they may have a single use or limited time of use.

A key is a virtual asset which, as the name implies, unlocks another gaming or networking event. For example, a key may be redeemable for 100 spins of a specified play-for-fun game. The key would count down and expire when the free play was consumed. As a second example, a key that unlocks a premium casual game may be designated as single use. The player may sell the key or they may use it to unlock the associated game. Objects with EV are always consumed and cease to exist when the EV is exhausted. For example, an object may have an EV worth $5.00 in credits that can be converted into a corresponding number of free spins. The object may be sold to another player before it is used. The object is removed or deleted when the EV is consumed. Some objects may be permanent or persistent (like virtual property). For example, a player might purchase a premium avatar from an online store and subsequently sell that avatar to another player.

Virtual assets may further be either useful or ornamental. Useful assets perform an action or enable a feature, for example, keys that unlock online games or game features; keys that reveal a clue or hint needed for an online puzzle or challenge; an asset redeemable for a shopping trip in a virtual store. Ornamental assets are primarily used for player customization, and may include assets such as premium player avatars, accessories for your avatar(s), graphical decorations such as skins, wallpapers or backgrounds, and premium sounds or ringtones. Virtual assets can be acquired in various ways including being awarded by an in-casino game, awarded by an online game, purchased from an online merchant, or purchased or traded from other players.

In an embodiment, points are a form of virtual currency used within the system. They may be a flexible, fluid currency that players can accumulate or spend. In an embodiment, points may have an EV associated with them which may require heightened levels of security for transactions involving points. In other embodiments, points may have no EV associated with them, which may permit a lower level of security in transacting points. In some embodiments, it may be desired to have multiple categories of points. For example, there may be some points that can be redeemed for cash and some other points that may only be spent on digital assets. Points, like other virtual assets, may have a digital representation. For example, points may either appear in their own window with a digital representation like gold bars or, in another example, an alphanumeric or graphical representation on a player's avatar. In the avatar example, if a player had enough points their avatar could be modified so to be holding a huge sack of money that grows in proportion to the amount of points they have. In an embodiment, each point has some cash value, for example having a worth of one-tenth of a cent (1000 to the dollar.) Internationally, the value of points may be either linked to the dollar, or points earned in different currencies may be kept separately, and allowed to be only utilized on systems or gaming terminals in the relevant markets where such currency is utilized.

Points may be earned during game play, or alternatively they may be purchased. For example, a player may earn points by selling other assets, such as things; social networking activities, such as submitting reviews that have received a rating of "helpful"; purchasing points with real money; in-casino game play; or in-casino promotions, such as playing games with ads that might have corporate sponsors. Players may sell things (or other virtual assets) they have earned or collected in exchange for points. Points may also be earned through non-gaming activities on other portals of the system. These activities may include playing non-wagering games or entertainment games on the system, for example via the social networking portion of the system; watching advertisements on the social networking system; writing or submitting content for reviews or chat boards on the system; selling creative content on the system; making a purchase of some kind from a vendor having access to the system, where the purchase is accompanied by an award of points from such sponsor as a promotion.

Points may also be purchased directly by players through the social networking's web portals. Moreover, points may be purchased by casinos, other gaming manufacturers, and third parties for use in promotions and as part of games. In other embodiments, points may be earned through casino play, in direct proportion to coin-in, and may be funded by a percentage of coin-in on participating games. Players may also earn points through internet promotions and casino promotions which can be funded by casino operators, gaming manufacturers, or other third party advertisers. Earning or receiving points may require compliance with eligibility rules, such as meeting a condition, watching an advertisement, playing an advertisement, visiting a casino or playing a certain wagering game or gaming terminal. A casino host or other appropriate casino personnel can directly fund a player's account with points, as part of ongoing promotional efforts. Moreover, player accounts may be limited to a certain number of points per promotion. Additionally, players may be given special points which they themselves must give away in the form of offers or gifts to other players, which further stimulates interest in the virtual economy. In an embodiment, points are primarily used to buy things or other virtual assets, and form the basis of currency in the virtual economy. In other embodiments, points may be used to buy comps or services within casinos or operator facilities.

In other embodiments, the various virtual assets themselves may be embedded with software code, which may for example contain rule sets. Thus, although a virtual asset may be represented statically, such as a graphic appearing on a video display, it may be stored in memory as a live application or code. By being a live application, the virtual asset may perform various functions, such as connecting with a server or other computers, downloading and uploading data, and refreshing or updating itself with new rules or code. Thus for example, a virtual asset such as a trophy may interact with other assets or objects. For example, in a poker application, a "Royal Flush" trophy may be awarded to a player achieving a royal flush in a poker game. The Royal Flush trophy may be stored in memory as a live application having its own rules which monitors the player's receipt of other assets. If a player is subsequently awarded a second trophy, for example a "Straight Flush" trophy, the Royal Flush trophy may recognize the receipt of the second trophy, which in turn may cause the Royal Flush trophy (in accordance with its own rules) to award a third trophy (for example, a "High Hand" trophy).

In this way, virtual assets, such as trophies, may comprise functioning applications which contain rules for interacting with other objects. In another example, a virtual asset may have associated therewith code in the form of a decisional tree. For example, the code may have a variety of conditional steps associated with it. Suppose a player possessing a virtual asset (Item A) is allowed to acquire other assets (Items B and C). However, the internal rules and code of Item A further recognize that if the player also possesses a second asset (Item D), then it permits the player to unlock or obtain other assets (Items E and F). In this way, the internal code and rule sets of assets interact with the game code to control play.

As seen in Table 1 herein, each of the virtual assets may have a plurality of attributes associated therewith which are acted upon by one or more rule sets during play. The attributes may include persistence (whether or not an asset is permanent or has a limited usable life); tradability (whether or not an asset can be purchased, sold, or otherwise traded, and if so, in what value or currency); expected value (whether or not the asset has a cash value associated with it) and virtual value (whether or not the asset has a perceived value associated with it, and if so, whether such perceived value is fixed or controlled by some market affected by players purchasing, selling, or trading such asset). The attributes displayed in Table 1 are examples of attributes which may be utilized in a gaming system. It should be understood that in other embodiments, a large variety of attributes may be used with various types of virtual assets.

The various virtual assets described herein may be utilized in a variety of ways as an integral part of the wagering games of the system, and in conjunction with the social networking aspects of the system(s) described herein. As discussed, virtual assets may be stored and tracked in a player registry associated with a player's account, for example in the form of a player profile or trophy room. Such virtual assets may be displayed to the player in a variety of ways, including for example on a primary display of a gaming terminal in which a player is actively playing, a community display in the casino, or via the display on a mobile device, PDA, mobile telephone, or home computer, such as a laptop. Such virtual assets may be viewed and tracked locally within a casino or operator facility, or may be tracked over a connection through the internet or an internet service provider, such as via a website forming part of the social networking site operated in conjunction with the system.

The virtual assets may be won in a variety of ways. Gaming events, such as winning outcomes, may be associated with an award of one or more of the types of virtual assets described herein. Moreover, such virtual assets may be awarded randomly to players based upon a variety of gaming and non-gaming events. For example, promotions within casinos may be focused on awarding virtual assets, in addition to, or instead of, cash value prizes. Additionally, the amount or nature of virtual assets awarded to a player may be dependent upon player's accounts, player level or status, accumulation of other assets, or virtually any other criteria of a player's account or profile that may be monitored by the system and evaluated by one or more rule sets. For example, a "platinum" player may receive a different number or quality of virtual assets for a particular event as compared to a "silver" player. Many other configurations are possible.

In some embodiments, some achievements may be awarded based upon accumulation of other achievements or assets, such that the awarding of virtual assets is subject to a hierarchy. For example, collecting achievements such as ribbons may permit a player to be awarded a higher level achievement, such as a medal, in accordance with one or more rule sets. In an example, collecting ten ribbons provides a player with a medal as an achievement, while further still, collecting ten medals awards the player a trophy, as an achievement or asset. Such hierarchy may be provided to players in a number of ways, including via gaming terminals or over the internet. Moreover, the rules set(s) of the system may further govern which players may win higher level achievements. For example, in an embodiment, only one player may win a trophy (a higher level achievement) even though all players are eligible to win lower level achievements. The player winning the trophy may satisfy certain criteria, for example, being the first one to win a certain number of lower level achievements. Other criteria may be employed as well.

In other embodiments, players may be permitted to know the hierarchy and rule set(s) such that they are aware of what collection of achievements is required to receive a higher level achievement. In alternative embodiments, the rule set(s) and hierarchy may be unknown to players. For example, a secret "Super Trophy" may exist, and although the players may know of the existence of this higher level achievement, they may not know how it is won. Thus, when a player achieves the requisite underlying achievements to be awarded the Super Trophy, receiving such higher level achievement will appear as a mystery or surprise to such player. In this way, the element of surprise is maintained in the awarding of higher level achievements.

In some embodiments, various virtual assets may be accompanied with location information, such that certain casinos and/or operators may "watermark" virtual assets in an effort to advertise where such assets were collected or earned. For example, a trophy won at a Harrah's casino may be watermarked with the Harrah's logo, such that it is known to the player (and other players) where the asset was earned (during game play at a terminal in a Harrah's casino). This provides operators with an opportunity to expand advertisement of their facilities, and gain good will in association with the luck of having such assets awarded. For example, a player having an abundance of virtual assets watermarked as Harrah's brand assets may advertise to other players that Harrah's casinos are lucky and that it is relatively easier to accumulate such virtual assets there. This may induce other players to play more at Harrah's casinos in an effort to collect such virtual assets, thus serving as a benefit to the casino operator in the form of revenue. The player himself may be more induced to play longer at Harrah's since he is left with the sense that when he plays at Harrah's casinos, he is luckier, or does better. In addition to watermarking, other graphical labeling techniques may be employed to designate an asset as having been achieved at a particular casino, location, or region.

Gaming manufacturers may also provide to various casinos and operators software which is specifically designed to monitor and administer virtual assets. Such a software tool may include management of the various rule sets which govern eligibility for and awarding of the various virtual assets. Operators using the tool may add or subtract virtual assets, change the attributes of assets, change the types of assets available, and change the value of various assets. Moreover, operators could use the tool to advertise the various virtual assets available, the nature in which they may be won, or to advertise special promotions involving such virtual assets in which, for example, the assets take on greater-than-normal value, or the players receive something of value or perceived value in the form of virtual assets.

Operators and gaming manufacturers may also work cooperatively in order to create associations between wagering games and casino locations. For example, certain manufacturers may partner with certain casinos such that the rule sets administered by such a virtual economy system may permit greater or faster accumulation of virtual assets when playing the partnered manufacturer's wagering games within the partnering casino operator's facilities. Certain casinos may be designated as preferred locations where the rule sets are amended to allow increased collection of virtual assets, greater value to such assets, greater redemption value of assets, or other premium features related to virtual assets. In one example, players within a particular casino or playing a particular manufacturer's wagering game or gaming terminal may be permitted to advance more quickly through a hierarchy of achievements. Whereas normally it may be required that ten ribbons be collected to earn a medal achievement, a player playing a Star Trek themed wagering game in a Harrah's casino may be promoted to a medal achievement after collecting only five ribbon achievements.

Moreover, the operator may further define the improvement or "acceleration" of such earning or accumulation of virtual assets based upon player status, player account level, player card level, or other criteria. For example, players holding Harrah's Total Rewards cards may be further differentiated by card level. A gold card holder may receive a first acceleration level (five ribbons required to earn a medal) while a platinum card holder may receive an improved second acceleration level (only three ribbons required to earn a medal). Other configurations to effectuate different accelerators are possible as well. In an embodiment, such acceleration information is stored in memory of the central gaming location, accessible to the administration of the virtual assets, for example, by the virtual asset server. In yet other embodiments, a variety of other information tracked or accessible to an operator may be used to configure the rule sets which govern collection of virtual assets. For example, information relating to player level, length of stay at the casino, average bet, player demographics, etc. may all be used to customize or tailor a rule set which governs how that player is eligible to earn, receive, collect, redeem, trade, buy, sell, or otherwise utilize available virtual assets.

Additionally, in other embodiments, any of the described virtual assets may have time limits or expirations associated with them, including all of the assets described in Table 1 herein. For example, things, keys, points, and achievements may all be associated with an expiration date, for example, one hour, one day, one week, one month, or one year. This provides a shelf-life for each such virtual asset which can be configured so as to optimize the use and/or redemption of such virtual assets. In yet other embodiments, receipt or collection of certain assets, such as achievements, may unlock other non-gaming experiences or events. For example, a player earning certain achievements or keys may be permitted to engage in a variety of non-gaming events over the social networking website. This may include, for example, playing entertainment games accessible only to players having such assets, achievements or keys. Other examples may include ability to improve player profiles, have premium graphics, sounds, or otherwise enhance environmental factors on the social networking site.

In yet other embodiments, a player may be able to create his or her own virtual assets, such as customized player achievements. Such a player may offer his specially configured achievements to friends, family, or members of that player's buddy list, for example. Software accessible over gaming terminals or via the social networking site may permit players with tools to build such player customized assets, and offer such assets to others in the gaming or networking community. This may be further improved with the ability to permit players to issue challenges to other players, such as his or her friends or buddies, or to players in general as part of the community. A player creating such a challenge may be rewarded with additional or improved virtual assets by other players' inability to complete the challenge, whereas players accepting such a challenge may be awarded with additional or improved virtual assets by successfully completing the challenge.

Moreover, in other embodiments, the social networking aspect of the system may permit players to provide input for future use. For example, players may provide input on goals or desired achievements, which the operator may then use to create new achievements or other virtual assets when the operator perceives that a substantial or significant population of players would benefit from such creation. This may in turn lead to new sub-communities within the social networking site of players similarly situated with goals and desired achievements, which may in turn foster additional input and more growth of both gaming and social networking events. The system may use tags or markers with which to monitor player's goals or desires. For example, the software of the system may monitor player profiles for certain tags which are associated with players' desired goals, plans, or desired changes to the system. By collecting such tagged information, the system can modify future virtual assets as well as the rule sets governing how they are earned, redeemed, and otherwise administered.

The social networking website and its components administered by the system may provide an arena in which virtual assets are managed, even by persons who are not wagering game players. For example, persons part of the social networking environment may not engage in wagering games within casinos and operator facilities. However, they may have a desire for collecting and redeeming virtual assets to improve their social networking experience. In one example, a non-gaming participant in the social networking site may want to collect achievements or other assets to improve the graphics of his player profile, or to play entertainment games available only to those having certain assets. The social networking site may further permit brokering of virtual assets in an effort to assist players needing certain assets and desirous of trading for or purchasing such assets.

In another alternative embodiment, one or more "virtual trophies" may be used to stimulate game play and competition. For example, a virtual trophy may be provided to a player for receiving or accomplishing certain tasks or achievements during game play. In one embodiment, separate virtual trophies are created for achievements such as largest jackpot, most games played, most assets collected, most points earned, collection of certain symbols, advancement to highest episodes or stages, etc. The virtual trophies may be awarded for various achievements both inside of a casino or gaming environment, or remote therefrom, for example via game play on the internet, or a mobile device. In one embodiment, player's participation and collaboration on internet websites is a metric for which one or more trophies are awarded. The virtual trophies may be "travelling" trophies in the sense that when a person's achievement is surpassed by another player, the virtual trophy is passed from the first player to the second player. In one embodiment, the players' game play and accumulation of achievements is monitored via their player accounts, stored on a gaming system. The second player "winning" the trophy by overtaking the achievement of the first player possessing the trophy is notified of his receiving the virtual trophy while the first player "losing" the trophy is notified of his loss of the trophy. The first player may also be encouraged to return or continue game play in an effort to re-take the trophy. The encouragement may include audio and video displays, as well as incentives for game play. The travelling trophy may be optionally associated with a leader board that indicates how close players are to overtaking the leader and possessing the trophy.

Moreover, the gaming system operator (casino) as well as gaming device manufacturers may maintain internet websites to monitor, track, post results, and encourage game play through advertisement of the virtual trophies. The available trophies may be advertised along with the current possessor of the trophy and the current achievement necessary to overtake the possessor and gain the trophy. Moreover, players may be permitted to create their own personal websites (either linked to the casino and manufacturer sites, or remote therefrom) in which they can showcase their personal gaming achievements, including, for example, possession of certain trophies, achievements associated therewith, time of possession of trophies, etc. In one embodiment, players may maintain "virtual trophy cases" in which to show off and promote their current and past trophy winnings. Such trophy cases may be visible via websites, as well as via gaming devices, mobile devices, or other displays within a casino environment. In one embodiment, websites permitting wagering game play thereon may generate embeddable web objects which represent various players and their accomplishments or trophies. Such embeddable web objects may "follow" player icons, screen names, identifiers, or other representations to non-gaming websites and be inserted therein. This fosters and promotes play of the wagering game, by advertising player's gaming activities on non-gaming websites, such as social networking websites, for example.

The awarding, overtaking, loss of, transfer, and creation of virtual trophies may be advertised to players in any number of manners. Such events may be advertised, displayed or announced (visually and/or with audio) on individual gaming devices within a casino, including freestanding gaming devices and handheld devices. The events related to the virtual trophies may further be announced on personal mobile devices, casino signage located throughout a casino property, community displays, etc. For example, when a player possessing a trophy commences play at a gaming device (and the gaming device, via the player account on the system identifies the player), that player's possession of a certain trophy may be advertised by one or more displays or other signage on the gaming device, so as to promote to others in the casino that the player is a trophy holder. Moreover, the announcements may be made on internet websites as described above. By updated, displaying, and advertising these events, interest is generated in the competition for and receipt of the trophies. Players may be motivated by the "bragging rights" attendant to owning the trophy and being the "best" or having the highest associated achievement.

Moreover, player accounts on the system may permit players to create and maintain friends, contacts, associates, or "buddy lists" of other players. This may include their friends, family, relatives, etc. Through the system, players earning sufficient achievements to receive one or more virtual trophies may be permitted to notify persons on their contact or buddy lists of their accomplishment, furthering their ability to exercise "bragging rights" associated with the accomplishment. Messages may be broadcast to such persons (or any subsets thereof) via the system, which relate to and announce events associated with the creation, winning, loss, etc. of the virtual trophies. Gaming operators and/or manufacturers operating such systems may be provided with great flexibility to manage the virtual trophies via the gaming system and remote websites. For example, many forms of eligibility criteria may be imposed and controlled via one or more rule sets created and managed by gaming operators or manufacturers via the system or internet sites.

In yet another embodiment, a casino or operator may use the virtual assets and the economy supporting such assets to drive play to various casino sites, or even to specific areas or gaming terminals within a casino. For example, the rule set(s) created for administering the virtual assets available on the system may include a subset of rules for enhancing a player's collection of assets if particular geographical locations and/or timing is utilized in collection of the assets. In one example, a player may be informed by the system that if he or she collects a virtual asset or group of assets from a particular set of casinos, he or she will receive an enhancement thereto, or perhaps an acceleration thereto as described herein. Alternatively, the rule set may provide enhancements to players playing certain gaming terminals or wagering games within a casino. Time limits may be placed on such collection so as to incentivize players to play at certain casinos or locations within certain time periods. Thus, for example, a casino operator may drive players to increase revenue during certain traditionally lower-revenue time periods by incentivizing players via increased or accelerated virtual assets. Other adjustments to rule sets may be made in order to drive gaming traffic at appropriate locations and time frames.

It should be understood that any and all of the embodiments described herein may be implemented in an online casino gaming system, as well as traditional "brick-and-mortar" casino and wagering facilities. It should also be understood that in some embodiments, player information, including virtual asset information, is stored in a player account accessible by verification or recognition of a player identifier (such as a player card). In such embodiments, the information may be stored centrally, for example on a server, and recalled upon receipt of the player identifier. In other embodiments, player information (including virtual asset information) may actually be stored directly on the player card, or other tangible medium. For example, a smart card or key fob may be used as both a player identifier, as well as have memory in which player information is stored and downloaded to a gaming terminal or the system.

In yet other embodiments, casino operators may run special promotions related to the collections of virtual assets. For example, a monthly drawing may be provided (for example a drawing for $1,000.00), in which all players who earned a predetermined number of virtual assets (e.g. 50 Star Trek Medals) would be eligible to participate. Since the gaming system tracks the players (by player account information) who received the earned virtual assets, the system is able to identify the eligible players from the information stored therein. Thus, the system may dispatch systematic advertisement and promotional materials to such players regarding the special event. For example, all eligible players may receive an email, phone call, or postal mailing announcing the special drawing, and their eligibility for it. Additional prizes may be given to players for responding to such promotions, or participating in other ways.

In yet another embodiment, the gaming systems described herein may be used to administrate other promotions. For example, a "bottle cap" type promotion may be instituted and administrated via such a gaming system. During play of wagering games, players may earn virtual assets in the form of a unique code which is randomly generated and attached to a virtual asset. By earning the asset, the player gets the value of the asset being stored or logged in his or her player account, as well as the secondary value of the unique code attached thereto which allows the player to participate in a secondary game or drawing, provided certain eligibility criteria are satisfied. For example, all of the codes distributed in such manner may be maintained and monitored by the gaming system. Players receiving such codes may redeem them, for example by entering them at an appropriate website address over the internet, or even at a gaming terminal in a casino. The code could then be evaluated to see if the player redeeming it receives an associated prize or status associated with the code. Eligibility requirements for the codes may include having a certain set of virtual assets in one player's account. Thus, the randomly distributed codes provide a secondary level of award and thus, add anticipation and excitement to the collection of virtual assets.

The system and methods of the present invention offer substantial benefits to players and operators alike. By providing a virtual economy, various players are incentivized to engage in various game play to collect, receive, accumulate, redeem, accelerate or enhance virtual assets available on the system. Virtual assets may include things, points, keys, achievements, or other assets which are provided via a number of manners, both dependent upon and independent of game play. Various attributes of the available assets may further customize a player's experience, including the ability to buy, sell, trade, barter with or redeem the assets. Such virtual assets may be coordinated with activities outside of the casino, including non-gaming activities, so as to correspond with and enhance a social networking environment which interfaces with operators' systems. By promoting such virtual assets, a virtual economy may be created which fosters game play, and is additionally fostered by game players even when not in a casino. Other benefits are provided as well.

Each of these embodiments and obvious variations thereof is contemplated as falling within the spirit and scope of the claimed invention, which is set forth in the following claims.

What is claimed is:

1. A gaming system having virtual assets, comprising:

a wager input device;

at least one gaming terminal comprising a display for displaying a wagering game;

a virtual asset server in communication with the at least one gaming terminal, the virtual asset server storing and managing a first type and a second type of virtual non-monetary assets, the first type of virtual non-monetary asset having a first plurality of attributes associated therewith, the second type of virtual asset having a second plurality of attributes associated therewith, each of the first and second pluralities of attributes pertaining to (a) persistence—whether the asset is permanent or has a limited usable life, (b) tradeability—whether or not the asset can be purchased, sold, or otherwise traded, (c) expected value—whether or not the asset has a cash value associated with it, and (d) virtual value—whether or not the asset has a perceived value associated with it and if the perceived value is fixed or controlled by a market, at least two of the first plurality of attributes being different than the corresponding two of the second plurality of attributes; and at least one controller operative to:

(i) cause the first display to display the wagering game;

(ii) in response to a first triggering event, award one or more of the virtual non-monetary assets to a player of the wagering game;

(iii) store information regarding the awarded non-monetary virtual assets in a player account associated with the player and accessible to the virtual asset server; and (iv) provide a monetary award to the player for any winning outcomes achieved during play of the wagering game.

2. The gaming system of claim 1, wherein the at least one controller is further operative to permit consumption and redemption of the awarded virtual assets by the player.

3. The gaming system of claim 1, wherein the virtual assets stored in and managed by the virtual asset server are controlled in response to a master rule set governing permissible actions with the virtual assets.

4. The gaming system of claim 1, wherein at least one of the awarded virtual assets is associated with a local rule set for interacting with other ones of the virtual assets stored on the virtual asset server.

5. The gaming system of claim 4, wherein the local rule set interacts with other ones of the virtual assets stored on the virtual asset server independently of the master rule set.

6. The gaming system of claim 5, wherein the local rule set is downloaded and stored in memory of the gaming terminal in response to the player account being accessed.

7. The gaming system of claim 1, wherein the attributes govern a manner in which the virtual assets are at least one of collected, redeemed, distributed, and earned.

8. The gaming system of claim 1, wherein the first and second types of virtual assets are each selected from a group consisting of:

(i) achievements awarded for accomplishments within the wagering game or for participating in events;

(ii) virtual objects;

(iii) keys for unlocking events within or outside the wagering game, and (iv) points that are purchased, or earned during play of the wagering game.

9. A method of conducting a wagering game comprising:

accessing and recalling a player account in response to receiving a player identifier; receiving a wager;

displaying a wagering game on a display of a gaming terminal;

storing and managing a first type and a second type of virtual non-monetary assets on a virtual asset server in communication with the gaming terminal, the first type of virtual asset having a first plurality of attributes associated therewith, the second type of virtual asset having a second plurality of attributes associated therewith, each of the first and second pluralities of attributes pertaining to (a) persistence—whether the asset is permanent or has a limited usable life, (b) tradeability—whether or not the asset can be purchased, sold, or otherwise traded, (c) expected value—whether or not the asset has a cash value associated with it, and (d) virtual value—whether or not the asset has a perceived value associated with it and if the perceived value is fixed or controlled by a market, at least two of the first plurality of attributes being different than the corresponding two of the second plurality of attributes;

in response to a triggering event, awarding one or more of the virtual non-monetary assets to the player;

storing information regarding the awarded virtual non-monetary assets in the player account associated with the player and accessible to the virtual asset server; and providing a monetary award to the player for any winning outcomes achieved during play of the first wagering game.

10. The method of claim 9, wherein virtual assets stored in and managed by the virtual asset server are controlled in response to a master rule set governing permissible actions with virtual assets.

11. The method of claim 10, wherein at least one of the awarded virtual assets is associated with a local rule set for interacting with other ones of the virtual assets stored on the virtual asset server.

12. The method of claim 11, wherein the local rule set is downloaded and stored in memory of the gaming terminal in response to the player account being accessed.

13. The method of claim 9, wherein the attributes govern a manner in which the virtual assets are at least one of collected, redeemed, distributed, and earned.

14. A gaming system having virtual non-monetary assets, comprising:

a wager input device;

a plurality of gaming terminals, each gaming terminal comprising a display for displaying a wagering game;

a virtual asset server in communication with the plurality of gaming terminals, the virtual asset server storing a plurality of player accounts and a set of virtual non-monetary assets associated with each player account, the virtual asset server further storing a master rule set for management of virtual non-monetary assets, wherein the virtual non-monetary assets are not redeemable for cash value, are persistent over a plurality of wagering games played by a player associated with the player account associated with the virtual non-monetary assets, wherein the virtual non-monetary assets include at least two of the attributes of (a) tradeability—whether or not the asset can be purchased, sold, or otherwise traded, (b) expected value—whether or not the asset has a cash value associated with it, and (c) virtual value—whether or not the asset has a perceived value associated with it and if the perceived value is fixed or controlled by a market; and at least one controller operative to:

in response to input of a player identifier, identify the player at one of the plurality of gaming terminals;

recall the player account associated with the player;

recall a set of virtual non-monetary assets associated with the player account;

modify the set of virtual non-monetary assets based upon the player's collection, redemption and disposition of virtual non-monetary assets during play of the wagering game;

provide a monetary award to the player for any winning outcomes achieved during play of the wagering game; and store the modified set of virtual non-monetary assets in the virtual asset server upon the player concluding play of the wagering game.

15. The gaming system of claim 14, wherein the types of available virtual assets comprises things, keys, achievements, and points.

16. The gaming system of claim 14, wherein at least one virtual asset stored on the virtual asset server is associated with a local rule set for interacting with other ones of virtual assets stored on the virtual asset server.

17. The gaming system of claim 14, wherein the local rule set is downloaded and stored in memory of the gaming terminal at which the player has been identified.

18. The gaming system of claim 14, wherein the virtual asset server is further in communication with one or more computers over the internet, said one or more computers displaying virtual asset information associated with at least one player account stored on the virtual asset server.

19. A method of conducting a wagering game having virtual non-monetary assets, comprising:

receiving at least one wager;

displaying a wagering game on a plurality of gaming terminal displays;

storing (i) a plurality of player accounts, (ii) a set of virtual non-monetary assets associated with each player account, and (iii) a master rule set for management of virtual non-monetary assets, on a virtual server in communication with the plurality of gaming terminals;

identifying a player at one of the plurality of gaming terminals in response to input of a player identifier;

recalling a player account associated with the player;

recalling a set of virtual non-monetary assets associated with the player account from a virtual asset server, the virtual asset server storing a first type and a second type of virtual non-monetary assets, the first type of virtual non-monetary asset having a first plurality of attributes associated therewith, the second type of virtual asset having a second plurality of attributes associated therewith, each of the first and second pluralities of attributes pertaining to (a) persistence—whether the asset is permanent or has a limited usable life, (b) tradeability—whether or not the asset can be purchased, sold, or otherwise traded, (c) expected value—whether or not the asset has a cash value associated with it, and (d) virtual value—whether or not the asset has a perceived value associated with it and if the perceived value is fixed or controlled by a market, at least two of the first plurality of attributes being different than the corresponding two of the second plurality of attributes;

modifying the set of virtual non-monetary assets based upon the player's collection, redemption and disposition of virtual non-monetary assets during play of the wagering game;

providing a monetary award to the player for any winning outcomes achieved during play of the wagering game; and storing the modified set of virtual non-monetary assets in the virtual asset server upon the player concluding play of the wagering game.

20. The method of claim 19, wherein the first and second types of available virtual assets comprises things, keys, achievements, and points.

* * * * *